US006811238B2

(12) United States Patent
Shingyohuchi

(10) Patent No.: US 6,811,238 B2
(45) Date of Patent: Nov. 2, 2004

(54) INK JET RECORDING APPARATUS, HEAD DRIVE AND CONTROL DEVICE, HEAD DRIVE AND CONTROL METHOD, AND INK JET HEAD

(75) Inventor: Mitsuru Shingyohuchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/948,280

(22) Filed: Sep. 7, 2001

(65) Prior Publication Data

US 2002/0036667 A1 Mar. 28, 2002

(30) Foreign Application Priority Data

Sep. 25, 2000 (JP) ..... 2000-289727

(51) Int. Cl.[7] ..... B41J 29/28

(52) U.S. Cl. ..... 347/11; 347/10; 347/68; 347/70

(58) Field of Search ..... 347/11, 10, 54, 347/70, 68

(56) References Cited

U.S. PATENT DOCUMENTS 5,644,341 A * 7/1997 Fujii et al. ..... 347/11
5,912,684 A * 6/1999 Fujii et al. ..... 347/54
6,174,038 B1 * 1/2001 Nakazawa et al. ..... 347/10
6,234,607 B1 * 5/2001 Sakai et al. ..... 347/54

FOREIGN PATENT DOCUMENTS

| | | |
|---|---|---|
| JP | 8-72240 | 3/1996 |
| JP | 9-39235 | 2/1997 |
| JP | 9254381 | 9/1997 |

* cited by examiner

*Primary Examiner*—Hai Pham
*Assistant Examiner*—Lam S Nguyen
(74) *Attorney, Agent, or Firm*—Cooper & Dunham LLP

(57) ABSTRACT

An ink jet recording apparatus includes an ink jet head having a nozzle, an ink channel, a diaphragm, and an electrode and a part applying first and second driving signals to the ink jet head. The first driving signal generates electrostatic force that deforms the diaphragm so as to eject an ink droplet from the nozzle. The second driving signal for controlling deformation of the diaphragm is applied after a predetermined period of time passes since application of the first driving signal.

49 Claims, 18 Drawing Sheets

FIG.26A
FIG.26B
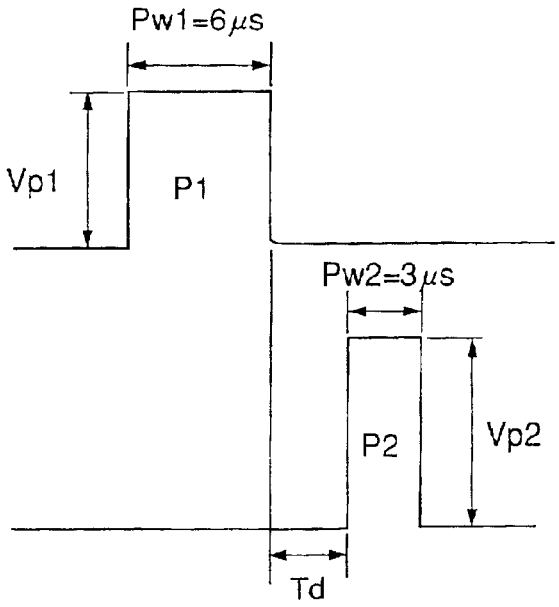
FIG.27
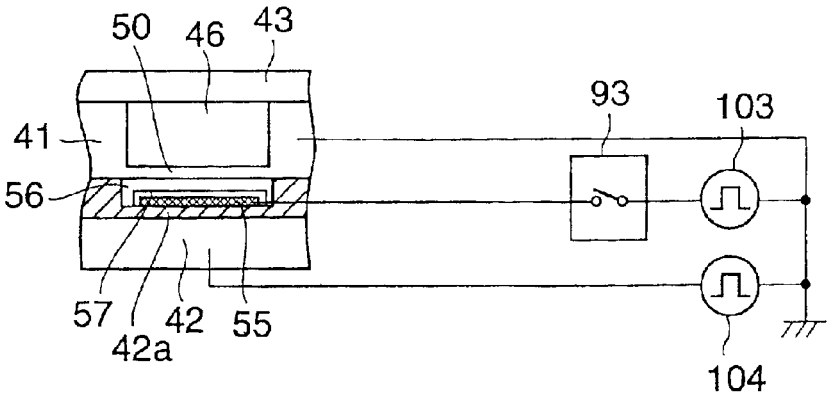

INK JET RECORDING APPARATUS, HEAD DRIVE AND CONTROL DEVICE, HEAD DRIVE AND CONTROL METHOD, AND INK JET HEAD

BACKGROUND OF THE INVENTION

1. Field of the Invention

The present invention relates to an ink jet recording apparatus, a head drive and control device, a head drive and control method, and an ink jet head.

2. Description of the Related Art

Employed in an ink jet head recording apparatus used as an image recording apparatus (an imaging apparatus) such as a printer, a facsimile machine, a copier, or a plotter is an electrostatic ink jet head including nozzles for ejecting ink droplets, ink channels (also referred to as ejection chambers, pressure chambers, liquid pressure chambers, or liquid chambers) communicating with the nozzles, diaphragms each forming a part of wall faces inside a corresponding one of the ink channels, and electrodes opposing the diaphragms so that the ink droplets are ejected from the nozzles by pressurizing ink in the ink channels by deforming and moving the diaphragms by means of electrostatic force.

The electrostatic ink jet head employs electrostatic force, storing smaller energy in the same volume compared with another type of ink jet head using piezoelectric elements or calorific resistances as actuator means. Therefore, the electrostatic ink jet head can reduce power consumption and operates at a higher rate by simultaneously driving numerous nozzles. That is, an ink jet head other than that of an electrostatic type ejects ink droplets by means of energy several hundred or thousand times as large as the kinetic energy of the ink droplets, so that heat is generated from extra energy in the head or a driver IC (a driving circuit), thus setting a limit to the number of nozzles operable at the same time or a driving frequency due to the effect of heat reserve.

Since an ink jet recording apparatus is required to achieve higher image quality and a higher recording rate, it is necessary for the ink jet recording apparatus to eject finer ink droplets at a higher frequency. However, due to a limit to an ejection frequency, it is difficult to perform high-speed recording only with fine ink droplets. Therefore, it has been desired of the ink jet recording apparatus to perform a multi-level operation of ejecting different amounts of ink droplets from the same nozzle.

In this case, a multi-level driving method is prevented from being established with the electrostatic ink jet head since it is difficult, compared with other methods, to control ink droplet ejection power with the multi-level driving method due to the direction of the electrostatic force, which can generate only attraction to attract the diaphragms toward the electrodes, and the nonlinearity of the electrostatic force, which is inversely proportional to the square of a distance between the diaphragms and the electrodes.

Further, there is a recent trend toward a smaller nozzle diameter to eject finer ink droplets, which entails a problem that nozzle clogging occurs more easily with the smaller nozzle diameter. Therefore, it is desired to eject ink droplets of a considerable size and a finer size with respect to a nozzle diameter.

Therefore, as a conventional electrostatic ink jet head, Japanese Laid-Open Patent Application No. 8-72240 discloses an ink jet recorder including a plurality of electrodes for ink droplet ejection which electrodes oppose one diaphragm and ejecting ink droplets of an amount corresponding to a gradation signal by changing the number of electrodes to be driven in accordance with the gradation signal.

Further, Japanese Laid-Open Patent Application No. 9-39235 discloses an ink jet head which has electrodes opposed to diaphragms and each formed to have a step-like structure so that large, middle, and small gaps are formed between the electrodes and corresponding diaphragms and ejects a variable amount of ink droplets by changing the deformation of each diaphragm by determining a level to which each diaphragm is deformed;

Further, Japanese Laid-Open Patent Application No. 9-254381 discloses an ink jet recording apparatus ejecting fine ink droplets by being drivable at a high frequency and shortening the natural frequency of ink by restricting the deformation of the diaphragms by forcibly placing diaphragms in contact with corresponding electrodes by applying a second driving voltage (an auxiliary voltage) lower than a first driving voltage at a timing when the diaphragms deformed by the applied first voltage approach the electrodes.

However, providing the electrodes for ink droplet ejection opposing the diaphragm as disclosed in Japanese Laid-Open Patent Application No. 8-72240 requires driving the electrodes independently of one another. This increases the number of interconnection lines and drivers to complicate an apparatus structure, thus resulting in a larger apparatus size and higher production costs.

Further, forming the electrodes opposing the diaphragms so that the electrodes each have a step-like structure so that large, middle, and small gaps are formed between the electrodes and corresponding diaphragms as disclosed in Japanese Laid-Open Patent Application No. 9-254381 requires a complicated head structure and production process, thus resulting in higher production costs. In order to drive a head having such a structure, it is necessary to apply a complicated driving waveform varying a driving voltage value. This complicates a driving circuit structure, thus causing higher production costs.

Furthermore, with respect to the ink jet recording apparatus disclosed in Japanese Laid-Open Patent Application No. 9-254381, it cannot be explained technically that finer droplets can be ejected at the shorter natural frequency, and practically, it is impossible to eject fine droplets with a droplet velocity being maintained.

SUMMARY OF THE INVENTION

It is a general object of the present invention to provide an ink jet recording apparatus, a head drive and control device, a head drive and control method, and an ink jet head in which the above-described disadvantages are eliminated.

A more specific object of the present invention is to provide an ink jet recording apparatus, a head drive and control device, a head drive and control method, and an ink jet head that enable fine droplets to be ejected by a simple structure.

The above objects of the present invention are achieved by an ink jet recording apparatus including: an ink jet head including a nozzle for ejecting an ink droplet, an ink channel communicating with the nozzle, a diaphragm forming a part of wall faces of the ink channel, and an electrode opposing the diaphragm, the diaphragm being deformed by electrostatic force so that the ink droplet is ejected from the nozzle; and a part applying to the ink jet head a first driving signal for generating the electrostatic force for ejecting the ink droplet from the nozzle and a second driving signal for controlling deformation of the diaphragm, the second driving signal being applied after a predetermined period of time passes since application of the first driving signal.

According to the above-described ink jet recording apparatus, the diaphragm is deformed toward the electrode at a timing and by an amount for ejecting a desired amount of ink by the application of the first driving signal, and thereafter, the deformation of the diaphragm is controlled by application of the second driving signal. Thereby, a fine ink droplet is ejected from the nozzle.

Additionally, in the above-described ink jet recording apparatus, the second driving signal may be applied to the electrode or to a substrate on which the electrode is formed, or the ink jet head may further include an additional electrode opposing the diaphragm and electrically separated from the electrode and the second driving signal may be applied to the additional electrode.

Thereby, the above-described ink jet recording apparatus has its electrode structure and/or driving circuit structure simplified.

The above objects of the present invention are also achieved by a head drive and control device for driving and controlling an ink jet head including a nozzle for ejecting an ink droplet, an ink channel communicating with the nozzle, a diaphragm forming a part of wall faces of the ink channel, and an electrode opposing the diaphragm, the diaphragm being deformed by electrostatic force so that the ink droplet is ejected from the nozzle, which head drive and control device includes a first part applying to the ink jet head a first driving signal for generating the electrostatic force for ejecting the ink droplet from the nozzle and a second driving signal for controlling deformation of the diaphragm, the second driving signal being applied after a predetermined period of time passes since application of the first driving signal.

According to the above-described head drive and control device, the diaphragm is deformed toward the electrode at a timing and by an amount for ejecting a desired amount of ink by the application of the first driving signal, and thereafter, the deformation of the diaphragm is controlled by application of the second driving signal. Thereby, a fine ink droplet is ejected from the nozzle.

Additionally, the above-described head drive and control device may further include a second part generating the first and second driving signals in time series.

Thereby, the above-described head drive and control device can selectively perform application of only the first driving signal or application of both of the first and second driving signals with a simple structure.

The above objects of the present invention are also achieved by a method of driving and controlling an ink jet head including a nozzle for ejecting an ink droplet, an ink channel communicating with the nozzle, a diaphragm forming a part of wall faces of the ink channel, and an electrode opposing the diaphragm, the diaphragm being deformed by electrostatic force so that the ink droplet is ejected from the nozzle, which method includes the step of applying a second driving signal for controlling deformation of the diaphragm to the ink jet head after a predetermined period of time passes since application of a first driving signal for generating the electrostatic force for ejecting the ink droplet from the nozzle.

According to the above-described method, the diaphragm is deformed toward the electrode at a timing and by an amount for ejecting a desired amount of ink by the application of the first driving signal, and thereafter, the deformation of the diaphragm is controlled by application of the second driving signal. Thereby, a fine ink droplet is ejected from the nozzle.

The above objects of the present invention are also achieved by an ink jet recording apparatus including: an ink jet head including a nozzle for ejecting an ink droplet, an ink channel communicating with the nozzle, a diaphragm forming a part of wall faces of the ink channel, and an electrode opposing the diaphragm, the diaphragm being deformed by electrostatic force so that the ink droplet is ejected from the nozzle; and a first part applying to the ink jet head a first driving signal for generating the electrostatic force so that the diaphragm is deformed to contact the electrode and a second driving signal having a peak value higher than that of the first driving signal, the second driving signal being applied before the diaphragm starting restoration by stopping application of the first driving signal reaches an equilibrium position of the diaphragm.

According to the above-described ink jet recording apparatus, when the application of the first driving signal is stopped, the diaphragm suddenly starts restoration to generate a pressure wave so that a satellite ink droplet is ejected from the nozzle. Thereafter, by applying the second driving signal, the restoring force of the diaphragm is weakened so that a main ink droplet is prevented from being ejected from the nozzle. Thereby, the satellite ink droplet is ejected as a finer ink droplet.

The above object of the present invention are also achieved by a head drive and control device for driving and controlling an ink jet head including a nozzle for ejecting an ink droplet, an ink channel communicating with the nozzle, a diaphragm forming a part of wall faces of the ink channel, and an electrode opposing the diaphragm, the diaphragm being deformed by electrostatic force so that the ink droplet is ejected from the nozzle, which head drive and control device includes a part applying to the ink jet head a first driving signal for generating the electrostatic force so that the diaphragm is deformed to contact the electrode and a second driving signal having a peak value higher than that of the first driving signal, the second driving signal being applied before the diaphragm starting restoration by stopping application of the first driving signal reaches an equilibrium position of the diaphragm.

According to the above-described head drive and control device, when the application of the first driving signal is stopped, the diaphragm suddenly starts restoration to generate a pressure wave so that a satellite ink droplet is ejected from the nozzle. Thereafter, by applying the second driving signal, the restoring force of the diaphragm is weakened so that a main ink droplet is prevented from being ejected from the nozzle. Thereby, the satellite ink droplet is ejected as a finer ink droplet.

The above objects of the present invention are further achieved by an ink jet including: a nozzle for ejecting an ink droplet; an ink channel communicating with the nozzle; a diaphragm forming a part of wall faces of the ink channel; a first electrode opposing the diaphragm to which first electrode a first driving signal for generating electrostatic force is applied, the electrostatic force deforming the diaphragm so that the ink droplet is ejected from the nozzle; and a second electrode to which a second driving signal for controlling deformation of the diaphragm is applied after a predetermined period of time passes since application of the first driving signal.

According to the above-described ink jet head, since the second driving signal for controlling the deformation of the diaphragm is applied to the second electrode other than the first electrode, a circuit structure for application of the second driving signal is simplified.

BRIEF DESCRIPTION OF THE DRAWINGS

Other objects, features and advantages of the present invention will become more apparent from the following detailed description when read in conjunction with the accompanying drawings, in which:

FIG. 26 is a diagram for illustrating a driving waveform according to the second embodiment;

FIG. 27 is a diagram for illustrating a variation of the second embodiment;

DETAILED DESCRIPTION OF THE PREFERRED EMBODIMENTS

A description will now be given, with reference to the accompanying drawings, of embodiments of the present invention.

In some parts of the following description, only one of a plurality of the same components may be illustrated representatively for simplicity purposes.

First, a description will be given of a first embodiment of the present invention.

Figure 1:
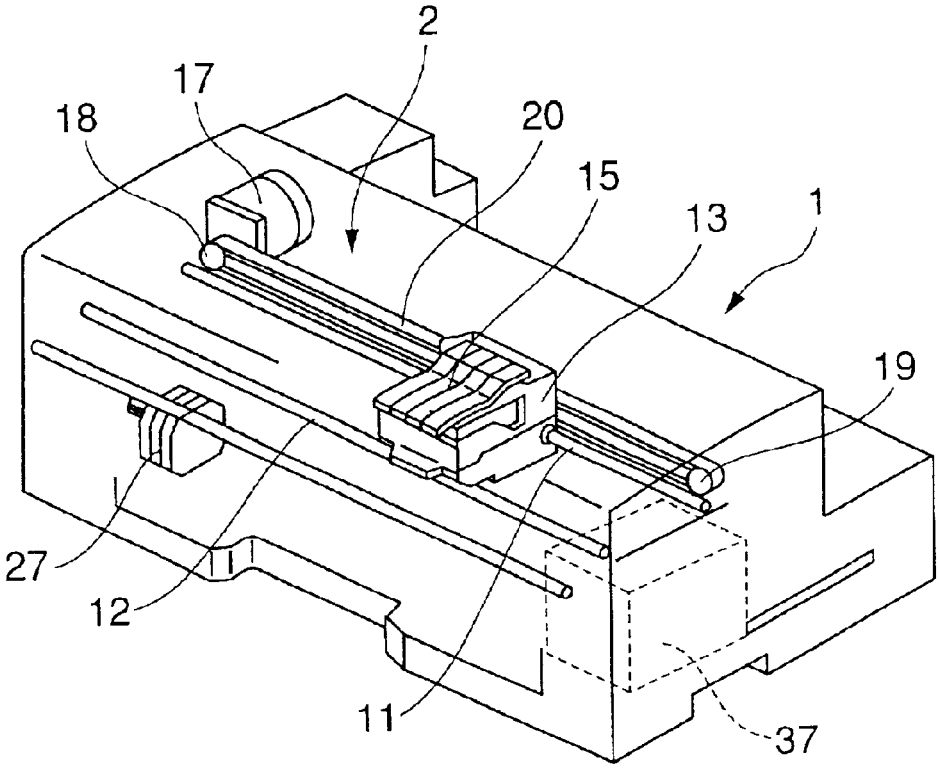
FIG. 1 is a perspective view of a mechanism part of an ink jet recording apparatus according to a first embodiment of the present invention.
Figure 2:
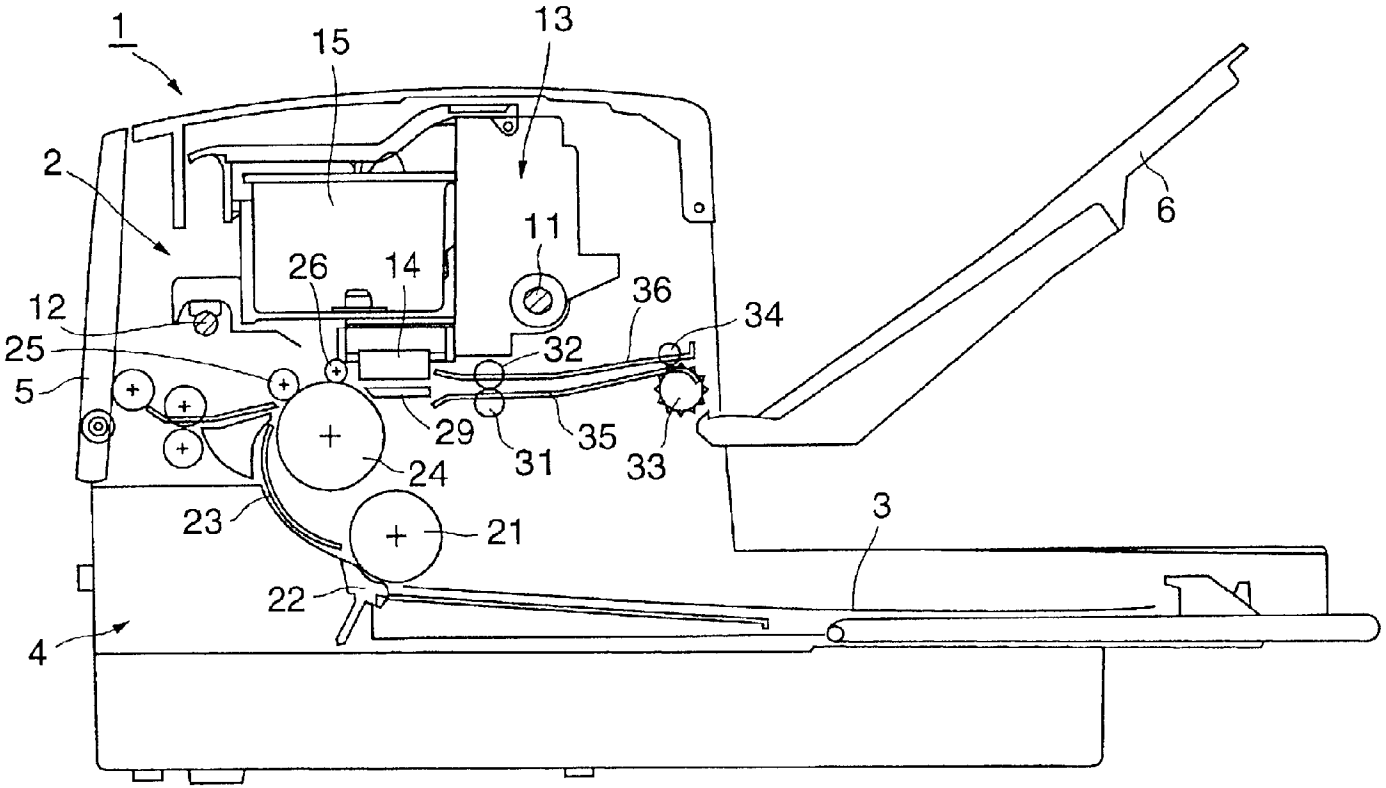
FIG. 2 is a side view of the mechanism part of FIG. 1.

FIG. 1 is a perspective view of a mechanism part of an ink jet recording apparatus according to the present invention. FIG. 2 is a side view of the mechanism part of FIG. 1.

The ink jet recording apparatus has an apparatus body 1 that includes a print mechanism part 2. The print mechanism part 2 includes a carriage 13 that is movable in a primary (main) scanning direction, a recording head 14 including ink jet heads 40 and mounted on the carriage 13, and ink cartridges (ink tanks) 15 for supplying inks of various colors to the recording head 14. A sheet of paper 3 is fed from a paper feed cassette 4 or a manual feed tray 5 to the print mechanism part 2, where a desired image is recorded on the sheet of paper 3. Thereafter, the sheet of paper 3 is ejected onto a paper ejection tray 6 that is attached to the backside of the apparatus body 1.

The print mechanism part 2 includes a main guide rod 11 and a sub guide rod 12 that are guide members provided between opposing side plates (not shown in the drawings), and the main guide rod 11 and the sub guide rod 12 slidably support the carriage 13 in the primary scanning direction or in a direction perpendicular to the plane of FIG. 2. The recording head 14 including the ink jet heads 40 for ejecting ink droplets of a variety of colors of yellow (Y), cyan (C), magenta (M), and black (Bk) are arranged on the carriage 13 so that the ink droplets are ejected in the downward direction of FIG. 2. The ink cartridges 15 for supplying the inks of the various colors to the recording head 14 are detachably mounted on the upper surface of the carriage 13.

The carriage 13 has its backside (a downstream side in a direction in which the sheet of paper 3 is conveyed) engaging slidably with the main guide rod 11 and its front side (an upstream side in the direction in which the sheet of paper 3 is conveyed) placed slidably on the sub guide rod 12. The carriage 13 has a timing belt 20 fixed thereto. The timing belt 20 is provided between a drive pulley 18 rotated by a primary scanning motor 17 and an idle pulley 19. The primary scanning motor 17 rotates in forward and reverse directions so that the carriage 13 repeats a scanning movement in the primary scanning direction.

The ink jet recording apparatus employs the ink jet heads 40 to eject the different colors as the recording head 14, but may employ one ink jet head including nozzles for ejecting the different colors. Further, as will be described later, each of the ink jet heads 40 is an electrostatic ink jet head including diaphragms each forming a part of wall faces inside a corresponding one of ink channels and electrodes opposing the diaphragms so as to pressurize ink by deforming and moving the diaphragms by means of electrostatic force.

In order to convey the sheet of paper 3 set in the paper feed cassette 4 to a position below the recording head 14, there are provided a paper feed roller 21 and a friction pad 22 for separating the sheet of paper 3 from the paper feed cassette 4 and conveying the sheet of paper 3, a guide member 23 for guiding the sheet of paper 3, a conveying roller 24 for conveying the fed sheet of paper 3 upside down, a conveying, roller 25 pressed against the conveying roller 24, and a top roller 26 for determining an angle at which the sheet of paper 3 is fed from the conveying roller 24. The conveying roller 24 is rotated by a secondary (sub) scanning motor 27 via a gear train.

A print support member 29 that is a paper sheet guide member is provided for guiding the sheet of paper 3 fed from the conveying roller 24 below the recording head 14 within the movement range of the carriage 13 in the primary scanning direction. A conveying roller 31 and a spur 32 rotated for conveying the sheet of paper 3 in a paper ejection direction, a paper ejection roller 33 and a spur 34 for conveying the sheet of paper 3 to the paper ejection tray 6, and guide members 35 and 36 forming a paper ejection path are provided on the downstream side of the print support member 29 in a direction in which the sheet of paper 3 is conveyed.

A reliability maintenance and recovery mechanism (hereinafter referred to as a sub system) 37 for maintaining and recovering the reliability of the recording head 14 is provided in an end part (the right end part in FIG. 1) in the primary scanning direction inside the apparatus body 1. In a standby state, the carriage 3 is moved on the side of the sub system 37 to have the recording head 14 capped by capping means of the sub system 37.

Figure 3:
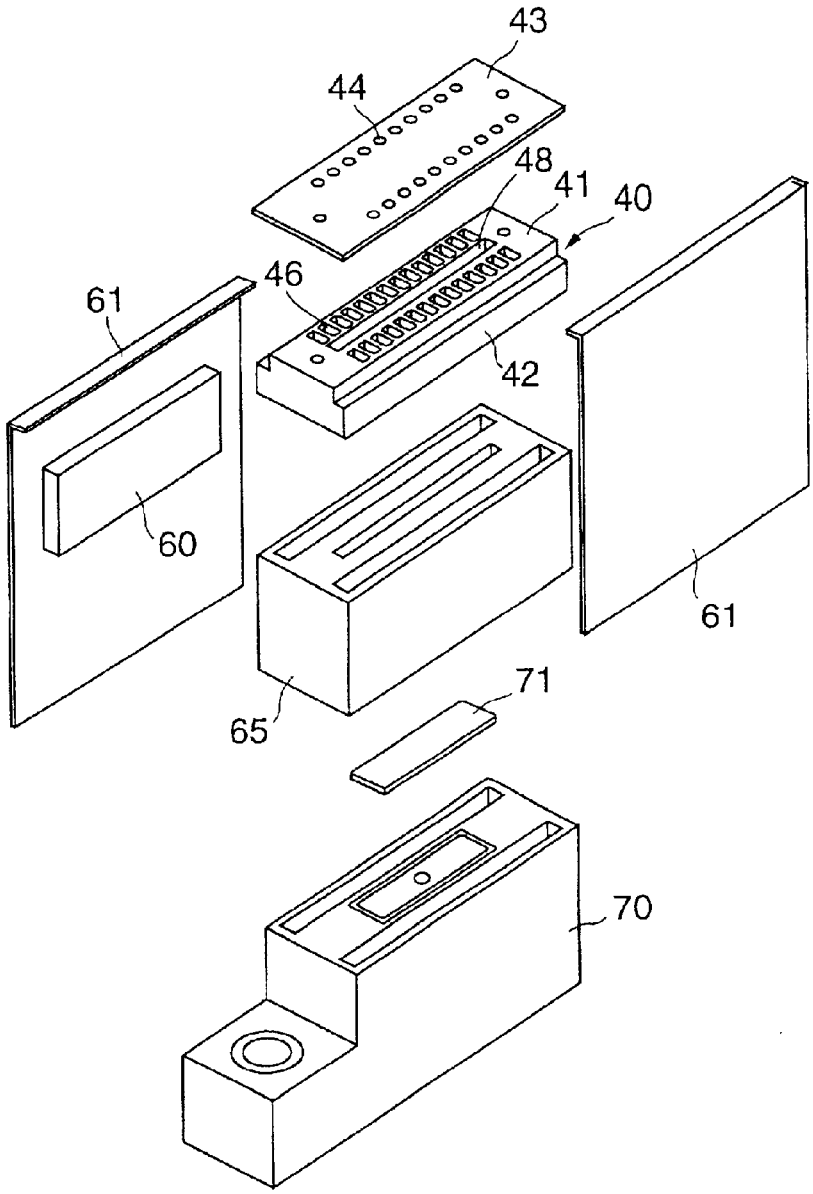
FIG. 3 is an exploded perspective view of an ink jet head of the ink jet recording apparatus of FIG. 1.
Figure 4:
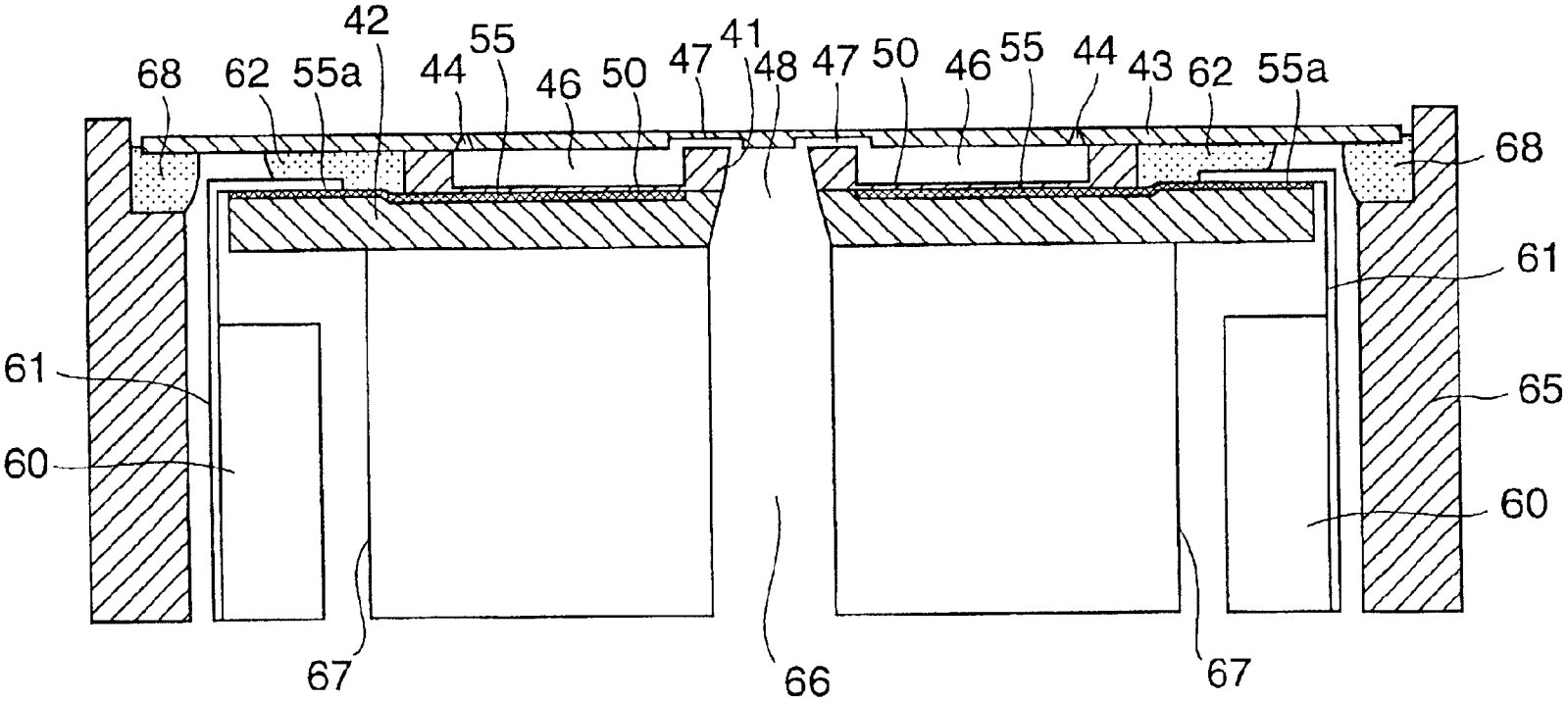
FIG. 4 is a sectional view of the ink jet head of FIG. 3 taken along a length of a diaphragm of the ink jet head.
Figure 5:
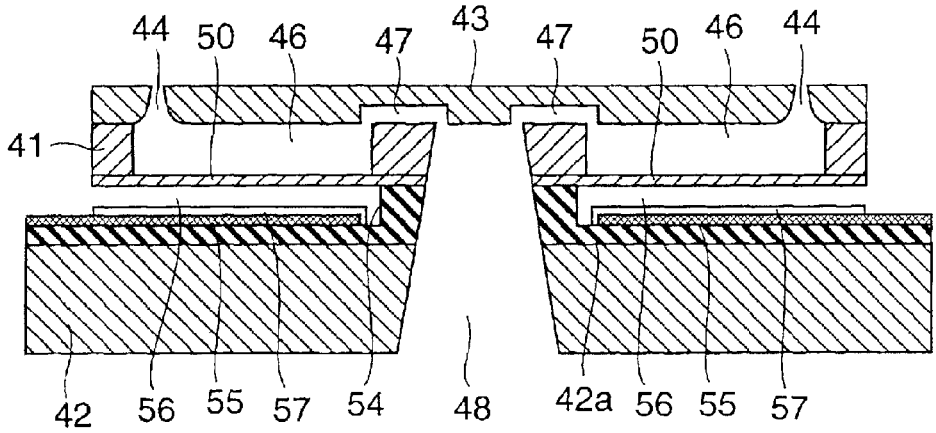
FIG. 5 is an enlarged sectional view of a principal part of the ink jet head taken along the length of the diaphragm.
Figure 6:
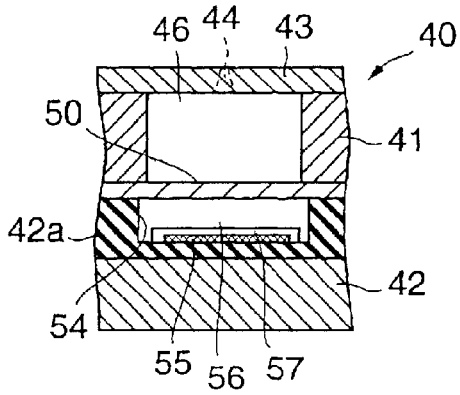
FIG. 6 is an enlarged sectional view of the principal part of the ink jet head taken along a width of the diaphragm.

Next a description will be given, with reference to FIGS. 3 through 6, of the ink jet heads 40 forming the recording head 14 of the ink jet recording apparatus. FIG. 3 is an exploded perspective view of the ink jet head 40. FIG. 4 is a sectional view of the ink jet head 40 taken along a length of each diaphragm 50 or along a line extending in a direction in which each diaphragm 50 extends. FIG. 5 is an enlarged sectional view of a principal part of the ink jet head 40 taken along the length of each diaphragm 50. FIG. 6 is an enlarged sectional view of the principal part of the ink jet head 40 taken along a width of each diaphragm 50 or taken along a line extending in a direction perpendicular to the direction in which each diaphragm 50 extends.

The ink jet head 40 includes a channel substrate 41 that is a first substrate formed of a single-crystal silicon substrate, a polycrystalline silicon substrate, or an SOI (Silicon On Insulator) substrate, an electrode substrate 42 that is a second substrate provided under the channel substrate 41 and formed of a silicon substrate, a Pyrex glass substrate, or a ceramics substrate, a nozzle plate 43 that is a third substrate provided on the channel substrate 41, thereby forming a plurality of nozzles 44 for ejecting the ink droplets, pressure chambers 46 that are ink channels communicating with the nozzles 44, and a common liquid chamber channel 48 communicating with the pressure chambers 46 via fluid resistance parts 47 serving also as ink supply channels.

Concave parts for forming the pressure chambers 46 and the diaphragms 50 serving as the bottom or wall faces of the corresponding pressure chambers 46 and also as first electrodes are formed in the channel substrate. Grooves for forming the fluid resistance parts 47 are formed in the nozzle plate 43. Further, a penetration part for forming the common liquid chamber channel 48 is formed through the channel substrate 41 and the electrode substrate 42.

In the case of employing a single-crystal silicon substrate as the channel substrate 41, for instance, first, boron is implanted in advance into the channel substrate 41 so that a high-density boron layer having a thickness of each diaphragm 50 is formed in the channel substrate 41. This boron layer serves as an etching stopper layer. Thereafter, the channel substrate 41 is joined to the electrode substrate 42. Then, the concave parts for forming the pressure chambers 46 are formed in the channel substrate 41 by anisotropic etching using a KOH aqueous solution so that the diaphragms 50 are formed with high accuracy with the high-density boron layer serving as an etching stopper layer. In the case of employing a polycrystalline silicon substrate as the channel substrate 41, the diaphragms 50 are formed by forming a silicon thin film, which is formed into the diaphragms 50, on the channel substrate 41 or by forming a polycrystalline silicon thin film on the electrode substrate 42 flattened with a sacrifice material and thereafter removing the sacrifice material.

An electrode film may be formed separately on the diaphragms 50, but in this case, the diaphragms 50 serves as electrodes by diffusing an impurity therein as previously described. Further, an insulation film may be formed on surfaces of the diaphragms 50 which surfaces face the electrode substrate 42. An oxide film of $SiO_2$ or a nitride film of $Si_3N_4$ may be used as the insulation film. The insulation film may be formed by forming an oxidation film by thermal-oxidizing surfaces of the diaphragms 50 or by a film formation method.

An oxide film layer 42*a* is formed on the electrode substrate 42 and concave parts 54 are formed in the oxide film layer 42*a*. Electrodes 55 that are second electrodes opposing the diaphragms 50 are provided on the bottom surfaces of the concave parts 54 and gaps 56 are formed between the diaphragms 50 and the electrodes 55. The diaphragms 50 and the electrodes 55 form actuator parts. The electrodes 55 have surfaces thereof covered with an electrode protection film 57 formed of an oxide film-based insulation film such as a $SiO_2$ film or a nitride film-based insulation film such as a $Si_3N_4$ film. However, an insulation film may be formed on the diaphragms 50 instead of forming the electrode protection film 57 on the surfaces of the electrodes 55.

In the case of employing a single-crystal silicon substrate as the electrode substrate 42, a normal silicon wafer can be used. The thickness of the silicon wafer depends on its diameter, but in most cases, a silicon wafer of four inches in diameter has a thickness of approximately 500 μm and a silicon wafer of six inches in diameter has a thickness of approximately 600 μm. In the case of using a material other than the silicon wafer for the electrode substrate 42, the bonding reliability of the electrode substrate 42 and the diaphragms 50 is increased if a difference in a coefficient of thermal expansion between the channel substrate 41 and the electrode substrate 42 is smaller.

The channel substrate 41 and the electrode substrate 42 may be bonded by an adhesive agent, but, in the case of forming the electrode substrate 42 of silicon, for instance, may be joined by a direct bonding method offering more reliable physical junction with an oxide film formed between the channel substrate 41 and the electrode substrate 42. The direct bonding is performed at a temperature as high as approximately 1000° C. Further, in the case of using glass for the electrode substrate 42, anodic bonding may be performed. In this case, anodic bonding is performed on the channel substrate 41 and the electrode substrate 42 with a Pyrex glass film being formed therebetween. Furthermore, in the case of employing silicon substrates as the channel substrate 41 and the electrode substrate 42, the channel substrate 41 and the electrode substrate 42 may be joined by eutectic bonding with a binder such as gold being interposed between the bonding surfaces of the channel substrate 41 and the electrode substrate 42.

Normally, a metal material such as Al, Cr, or Ni commonly used in a semiconductor element formation process, a refractory metal such as Ti, TiN, or W, or a polycrystalline silicon material whose resistance is lowered by an impurity may be used for the electrodes 55 of the electrode substrate 42. In the case of forming the electrode substrate 42 of the silicon wafer, it is required to form an insulation layer (that is, the above-described oxide film 42*a*) between the electrode substrate 42 and the electrodes 55. In the case of using an insulating material such as glass for the electrode substrate 42, it is unnecessary to form an insulation layer between the electrode substrate 42 and the electrodes 55.

Further, in the case of using the silicon wafer for the electrode substrate 42, impurity diffusion areas may be employed as the electrodes 55. In this case, an impurity having a conduction type opposite to that of the silicon substrate is employed for diffusion so that a pn junction is formed around each impurity diffusion area, thereby electrically insulating the electrode substrate 42 from the electrodes 55.

The nozzles 44 are arranged in two arrays in the nozzle plate 43, whose ejection surface (a surface facing toward a direction in which the ink droplets are ejected) is water-repellent. Here, the nozzle plate 43 is produced by Ni electroforming, but may also be produced to have a multi-layer structure of resin and metal layers. The nozzle plate 43 is bonded to the channel substrate 41 by an adhesive agent.

In the ink jet head 40, the nozzles 44 are arranged in the two arrays, and the pressure chambers 46, the diaphragms 50, and the electrodes 55 are also arranged in positions corresponding to the nozzles 44 in two arrays. The common liquid chamber channel 48 is arranged in a center part between the two arrays so as to supply ink to the pressure chambers 46 formed on both sides of the common liquid chamber channel 48. Thereby, a simply structured multi-nozzle head having numerous nozzles can be realized.

The electrodes 55 extend outward to have their tip parts serving as connection parts (electrode pad parts) 55*a*, to which FPC cables 61 each including a driver IC 60 that is a head driving circuit are connected via an anisotropic conductive film. As shown in FIG. 4, a space between the electrode substrate 42 and the nozzle plate 43 is hermetically sealed with a gap sealing agent 62 employing an adhesive agent of an epoxy resin.

The entire ink jet head 40 is bonded to a frame member 65 by an adhesive agent. An ink supply hole 66 for supplying the ink from outside to the common liquid chamber channel 48 of the ink jet head 40 is formed in the frame member 65. The FPC cables 61 are housed in hole parts 67 formed in the frame part 65.

A space between the frame member 65 and the nozzle plate 43 is hermetically sealed with a gap sealing agent 68 employing an adhesive agent of an epoxy resin so as to prevent ink on the water-repellent ejection surface of the nozzle plate 43 from going to the electrode substrate 42 and the FPC cables 61.

A joint member 70 connecting the ink jet head 40 and the corresponding ink cartridge 15 is joined to the frame member 65 so that the ink is supplied from the ink cartridge 15 via a filter 71 and the ink supply hole 66 to the common liquid chamber channel 48.

In the ink jet head 40, the diaphragms 50 are deformed toward the electrodes 55 by electrostatic forces generated therebetween by applying a driving voltage between the diaphragms 50 and the electrodes 55 serving as a common electrode and individual electrodes, respectively. Then, by discharging electric charges between the diaphragms 50 and the electrodes 55, the diaphragms 50 return from this state to their original forms, thereby changing the capacities (volumes) of or pressures in the pressure chambers 46 so that the ink droplets are ejected from the nozzles 44.

That is, when a pulse voltage is applied to the electrodes 55 serving as individual electrodes, potential differences are generated between the diaphragms 50 serving as common electrode and the electrodes 55 so that electrostatic forces are generated therebetween. Consequently, the diaphragms 50 are deformed in accordance with the magnitude of the applied voltage. Thereafter, by lowering the applied pulse voltage, the diaphragms 50 return to their original positions. The restoring forces of the diaphragms 50 increase the pressures inside the pressure chambers 46 so that the ink droplets are ejected from the nozzles 44. In this case, a method by which the diaphragms 50 are deformed until the diaphragms 50 contact the electrodes 55 (actually, the surface of the electrode protection film 57) is called a contact driving method and a method by which the diaphragms 50 are deformed only up to positions in which the diaphragms 50 are prevented from contacting the electrodes 55 is called a non-contact driving method.

Figure 7:
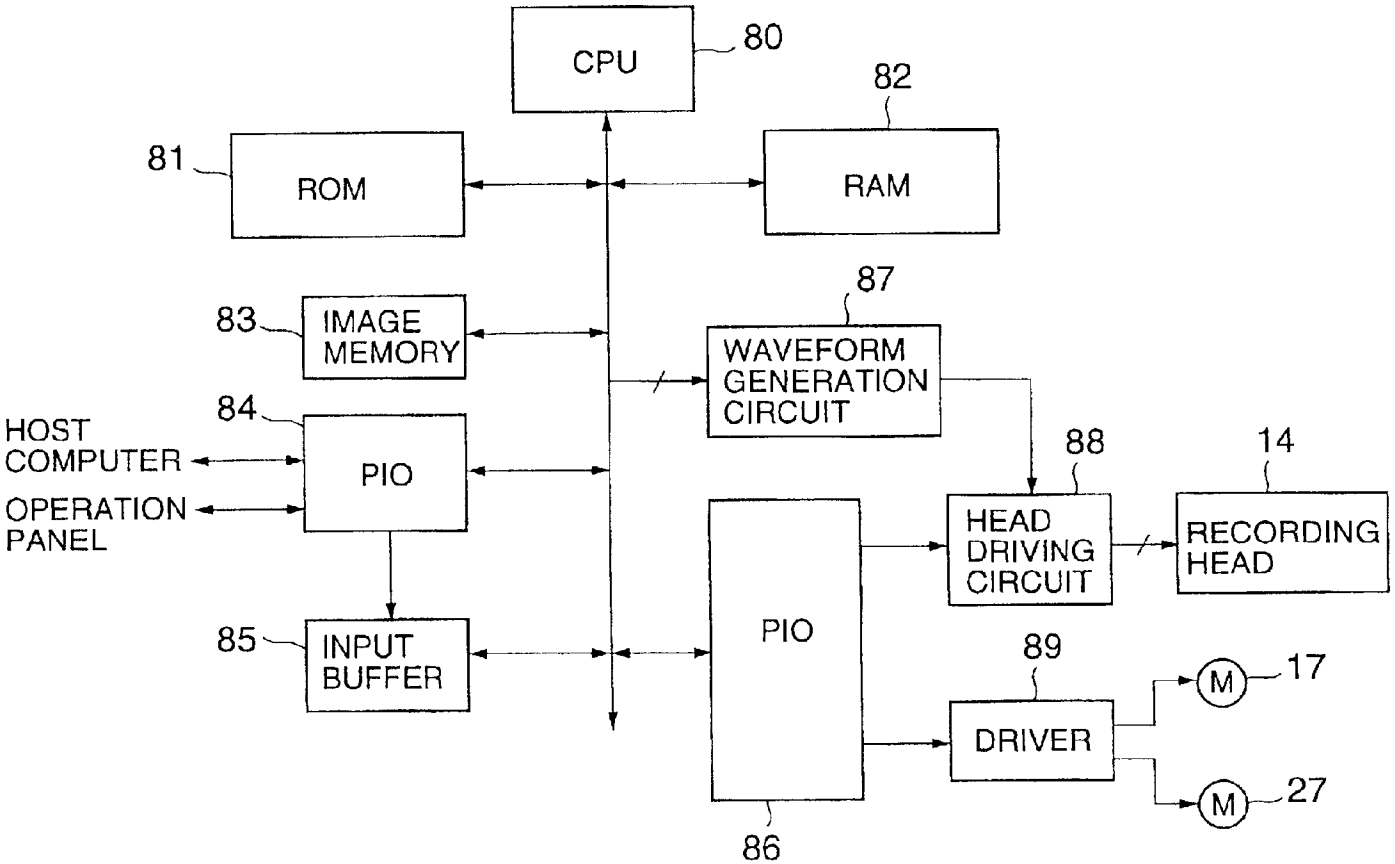
FIG. 7 is a block diagram showing a structure of a control part of the ink jet recording apparatus.

Next, a description will be given, with reference to FIG. 7, of an overview of a control part of the ink jet recording apparatus.

The control part includes a microcomputer (hereinafter referred to as CPU) 80 controlling the entire ink jet recording apparatus, a ROM storing necessary fixed information such as programs and the voltage value data of driving signals, a RAM 82 used as working memory, an image memory 83 for storing data obtained by processing image data transferred from a host computer, a parallel input-output (PIO) port 84, an input buffer 85, a PIO port 86, a waveform generation circuit 87, a head driving circuit 88, and a driver 89.

A variety of information such as image data, a variety of command information such as reliability recovery command information input from an operation panel (not shown), a detection signal supplied from a paper sensor detecting the leading and trailing edges of the sheet of paper 3, and signals from various sensors including a home position sensor detecting the home position (reference position) of the carriage 13 are input from the host computer to the PIO port 84. Necessary information is transmitted via the PIO port 84 to the host computer and the operation panel.

The waveform generation circuit 87 generates a first driving signal P1 for ink droplet ejection which signal generates energy for ink droplet ejection between the diaphragms 50 and the electrodes 55 of the corresponding ink jet head 40, that is, deforms the diaphragms 50 toward the electrodes 55 by an amount and at a timing required for a desired ink droplet ejection. The waveform generation circuit 87 further generates a second driving signal P2 for controlling the deformations of the diaphragms 50 after a predetermined period of time Td passes since the first driving signal P1. The waveform generation circuit 87 thus generates and outputs the first and second driving signals P1 and P2 in time series.

The head driving circuit 88 applies a driving waveform to energy generation part (the diaphragms 50 and the electrodes 55) corresponding to the nozzles 44 of the recording head 14 based on a variety of data and signals supplied via the PIO port 86. Further, the driver 89 controls the primary and secondary scanning motors 17 and 27 in accordance with driving data supplied via the PIO port 86 so as to move the carriage 13 in the primary scanning direction and convey the sheet of paper 3 by a given amount by rotating the conveying roller 24.

Figure 8:
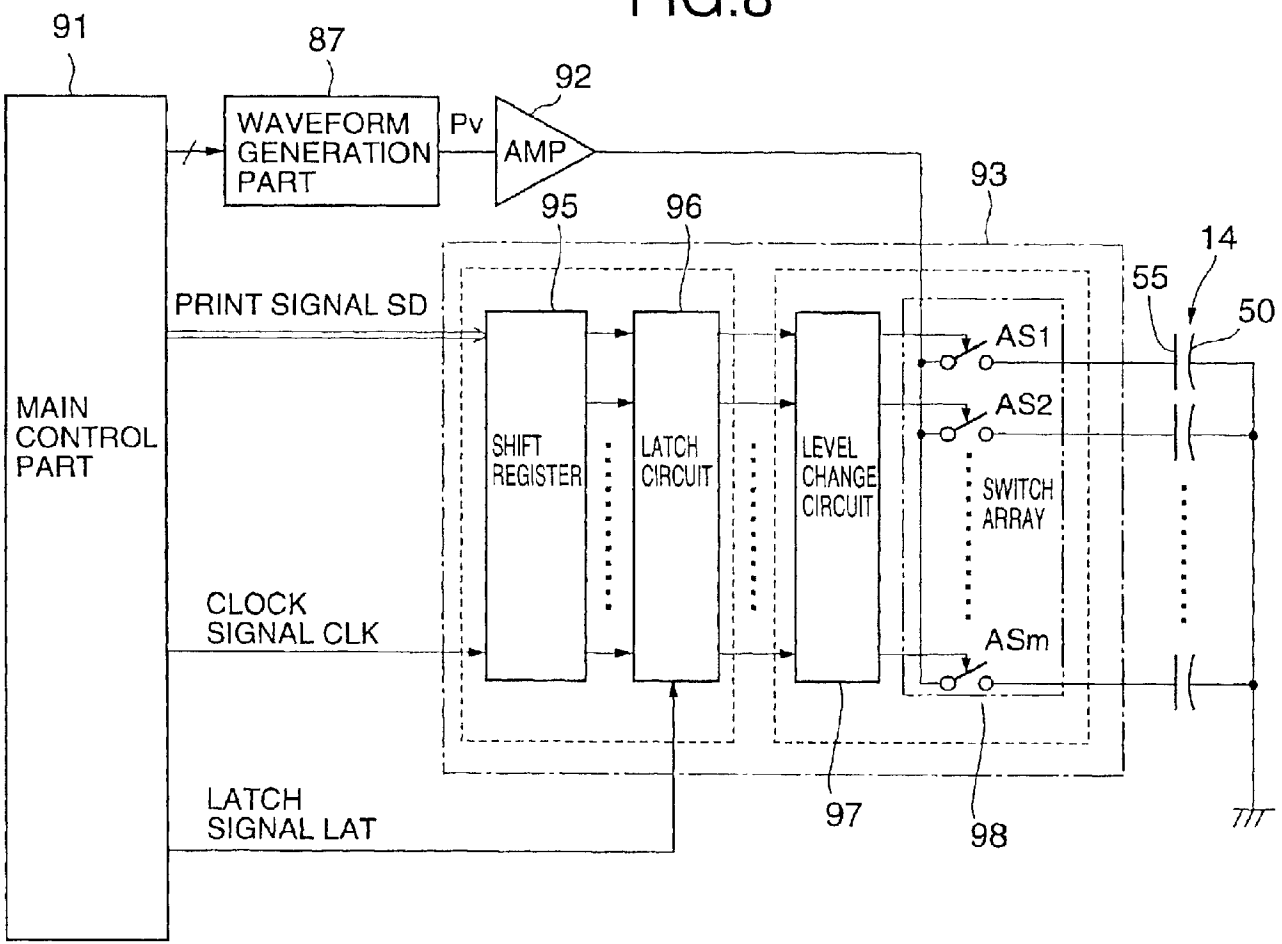
FIG. 8 is a block diagram showing a structure of a portion of the control part which portion is a head drive and control device according to the present invention.

Next, a description will be given, with reference to FIG. 8, of a part relating to a head drive and control part as a head drive and control device according to the present invention of the control part.

The head drive and control part includes a main control part 91 including the above-described CPU 80, ROM 81, RAM 82, and peripheral circuits, the waveform generation circuit 87, an amplifier 92, and a driving circuit (a driver IC) 93.

The main control part 91 supplies the waveform generation circuit 87 with data for generating the first and second driving signals P1 and P2 and supplies the driver IC 93 with a print signal SD that is serial data, a shift clock signal CLK, and a latch signal LAT.

The waveform generation circuit 87, as previously described, generates, in time series within one driving cycle, the first driving signal P1 that is a rectangular pulse signal generating the energy for ejecting the ink droplets from the nozzles 44 in the actuator parts of the ink jet head 40 and the second driving signal P2 that is a rectangular pulse signal controlling the deformations of the diaphragms 50 that returns to their original forms with the supply of the first driving signal P1 being cut after the predetermined period of time Td passes since the first driving signal P1.

The voltage data output from the main control part 91 is subjected to digital-to-analog (D/A) conversion in a D/A converter and is supplied to the waveform generation circuit 87 so that the waveform generation circuit 87 generates and outputs the first and second driving signals P1 and P2 in time series. The ROM 81 of the main control part 91 integrally stores data on the first and second driving signals P1 and P2 and the predetermined period of time Td. The ROM 81 and the waveform generation circuit 87 forms a part for generating and outputting the first and second driving signals P1 and P2 in time series.

The driver IC 93 supplies the first and second driving signals P1 and P2 supplied from the waveform generation circuit 87 to the electrodes 55 of the ink jet head 40 forming the recording head 14 in accordance with the print signal SD.

That is, the driver IC 93 includes a shift register 95 to which the shift clock signal CLK and the print signal (serial data) SD are supplied from the main control part 91, a latch circuit 96 latching a registered value of the shift register 95 based on the latch signal LAT supplied from the main control part 91, a level change circuit 97 changing the level of the output value of the latch circuit 96, and a analog switch array 98 whose ON/OFF operation is controlled by the level change circuit 97. The analog switch array 98 includes analog switches AS1 through ASm connected to the corresponding electrodes $\mathbf{55}_1$ through $\mathbf{55}m$ of the ink jet head 40. Here, m is the number of the nozzles 44. The diaphragms 50 serving as a common electrode are grounded.

The serial data (print signal) SD is captured into the shift register 95 in accordance with the shift clock signal CLK and the captured serial data SD is latched in accordance with the latch signal LAT in the latch circuit 96 to be input to the level change circuit 97. The level change circuit 97 switches ON and OFF the analog switches ASm (m=1 through m) connected to the electrodes 55 of the actuator parts in accordance with the contents of the data.

Since a driving waveform Pv (the first and second driving signals P1 and P2) is supplied from the waveform generation circuit 87 to the analog switches ASm (m=1 through m) via the amplifier 92, the driving waveform Pv is supplied to the electrodes 55 when the analog switches ASm (m=1 through m) are switched ON.

Here, a brief description will be given, with reference to FIG. 9, of the effects of the application of the driving waveform Pv by the head drive and control part.

Figure 9:
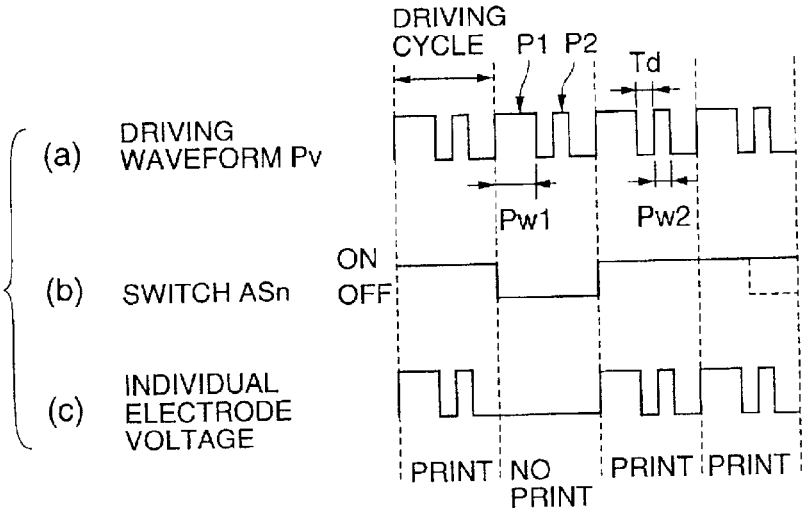
FIG. 9 is a diagram for illustrating an operation of the head drive and control device.

As previously described, in every driving cycle, the waveform generation circuit 92 generates and outputs the first driving signal P1 (rectangular pulses) and thereafter, at an interval of the predetermined period of time Td, the second driving signal P2 (rectangular pulses) in time series as shown in FIG. 9(*a*). Then, the first and second driving signals P1 and P2 are supplied to the analog switches ASm (m=1 through m) of the driver IC 93.

Therefore, by supplying the print signal SD from the main control part 91 to the driver IC 93, the analog switch ASn (n is one of 1 through m) of the driver IC 93 is switched ON or OFF as shown in FIG. 9(*b*), and the first and second driving signals (pulses) P1 and P2 are selected and supplied to the electrodes 55 of the ink jet head 40 as shown in FIG. 9(*c*) while the analog switch ASn is switched ON.

FIG. 9(*c*) shows pulses applied to one of the electrodes 55 which one corresponds to one of the nozzles 44. In the first driving cycle of FIG. 9(*c*), in which a print (drive) operation is requested, the first and second driving signals (pulses) P1 and P2 are successively applied to the electrode 55 so that fine or minute ink droplets are ejected from the corresponding nozzle 44. In the next (second) driving cycle, in which no print (drive) operation is commanded, neither the first nor second driving signal P1 nor P2 is applied to the electrode 55. In the next (third) driving cycle, where the print operation is again requested, the first and second driving signals (pulses) P1 and P2 are successively applied to the electrode 55 so that the fine ink droplets are ejected from the corresponding nozzle 44 as in the first cycle.

As can be seen from these operations, by changing the ON time length and/or OFF time length of the analog switch ASn in accordance with the print signal SD, a desired driving waveform Pv can be selected. Therefore, by switching OFF the analog switch ASn after application of the first driving signal (pulse) P1 in the fourth driving cycle as indicated by a broken line in FIG. 9(*b*), for instance, the print operation can be performed by ink droplet ejection by only the first driving signal P1 in the fourth driving cycle. That is, ejection of ink droplets of a normal size by applying only the first driving signal P1 or ejection of the fine ink droplets by applying the first and second driving signals P1 and P2 can be performed selectively, thereby enabling multi-level recording.

A description will now be given of the first and second driving signals P1 and P2 forming the driving waveform Pv generated in and output from the head drive and control device.

First, a description will be given, with reference to FIG. 10, of dependence of ink droplet ejection characteristics (an ink droplet ejection velocity or a drop velocity Vj and an ink droplet volume or a drop volume Mj) on a pulse width Pw of a driving waveform (a driving signal) in the ink jet head 40.

When the diaphragms 50 are attracted toward the electrodes 55 with a rectangular pulse voltage being applied to the electrodes 55, negative pressures are generated in the pressure chambers 46. Since pressures vibrate at the natural frequencies of the pressure chambers 46, a pressure in each pressure chamber 46 at a decay time of the pulse signal is a superposition of a residual pressure vibration at a rise time of the pulse signal and a pressure generated by restoration of the corresponding diaphragm 50.

Therefore, in the electrostatic ink jet head, its ink droplet ejection characteristic differs depending on a pulse width Pw of a pulse voltage applied thereto. That is, as shown in FIG. 10, the ejection characteristics (the drop velocity Vj and the drop volume Mj) vary depending on timing of pressure superposition by the pulse width Pw. In the case shown in FIG. 10, the ink jet head 40 has a structure that each pressure chamber 46 is 800 $\mu$m in length, each diaphragm 50 is 2 $\mu$m in thickness, and each nozzle 44 is 22 $\mu$m in diameter.

In the ink jet recording apparatus, the waveform generation circuit 87 generates and outputs the first driving signal P1 having a voltage value Vp1 and a pulse width Pw1 and the second driving signal P2 having a voltage value Vp2 and a pulse width Pw2 in time series as shown in FIG. 9(*a*) and, after the predetermined period of time Td passes since application of the first driving signal P1 is stopped, or since the end of a pulse decay time, starts to apply the second driving signal P2.

A description will now be given, with reference to FIGS. 11A through 11F, of a deformation of the diaphragm 50 at the time of applying the first and second driving signals P1 and P2 to the corresponding electrode 55.

Figure 11A:
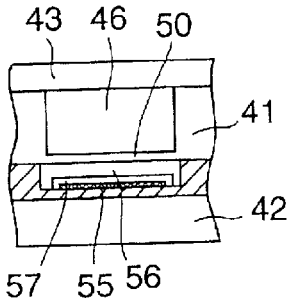
FIGS. 11A through 11F are diagrams for illustrating a deformation of the diaphragm according to the first embodiment.

First, in a state where no driving waveform is applied, the diaphragm 50 is in an equilibrium position (an initial position) as shown in FIG. 11A. When the first driving signal P1 is applied in this state, the diaphragm 50 is deformed toward the electrode 55 by an electrostatic force generated between the diaphragm 50 and the electrode 55 so as to contact the electrode 55, or the surface of the electrode protection film 57, as shown in FIG. 11B.

At this point, by making the first driving signal P1 fall (decay) until its application is stopped, the diaphragm 50 is released and tries to return to its equilibrium position, thereby pressurizing the ink in the corresponding pressure chamber 46 and generating energy for ink droplet ejection. However, during a transition period from the state shown in FIG. 11A to the state shown in FIG. 11B, a negative pressure is generated in the pressure chamber 46 and the pressure tries to vibrate at the natural frequency of the pressure chamber 46. Therefore, as previously described, an ejection force is a superposition of the residual pressure vibration and the restoring force of the diaphragm 50.

Thereafter, the diaphragms 50 tries to vibrate centered on its equilibrium position due to the pressure vibration and inertia of the pressure chamber 46. Therefore, the diaphragm 50 passes its equilibrium position as shown in FIG. 11(*c*) to deform further in a direction away from the electrode 55 as shown in FIG. 11(*d*).

Figure 11D:
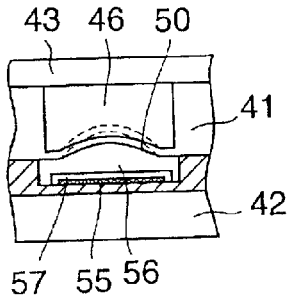
Figure 11B:
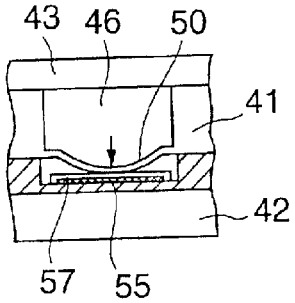
Figure 11E:
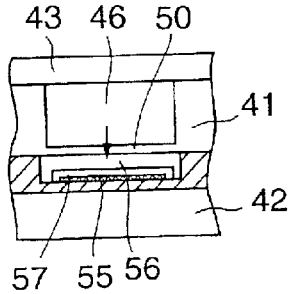
Figure 11C:
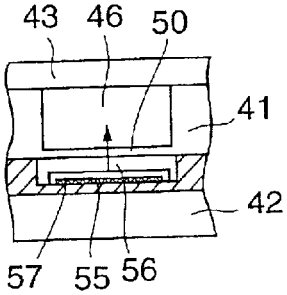
Figure 11F:
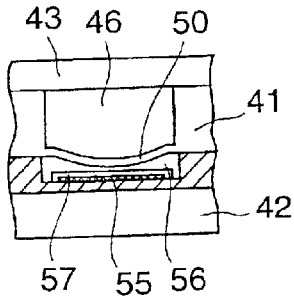

When the second driving signal P2 is applied after the predetermined period of time Td passes since the application of the first driving signal P1 is stopped, an electrostatic attraction is again generated between the diaphragm 50 and the electrode 55, controlling the deformation of the diaphragm 50 that tries to deform until reaching a position furthest from the electrode 55 which position is indicated by broken lines in FIG. 11D. Therefore, the deformation of the diaphragm 50 is stopped in a position indicated by solid lines in FIG. 11D, and then the diaphragm 50 starts to deform toward the electrode 55, returning to its equilibrium position as shown in FIG. 11E. In this case, by making the second driving signal P2 decay until its application is stopped, the diaphragm 50 stops substantially at its equilibrium position and is prevented from again contacting the electrode 55.

Thus, by starting ink droplet ejection by the first driving signal P1 and applying the second driving signal P2 after the predetermined period of time Td passes since the application of the first driving signalP1 is stopped, the first driving signal P1 is prevented from causing extra ink to follow an ink column formed outward from the ink meniscus surface of the nozzle 44 so that a fine ink column can be formed. Further, ink supply to the rear end of the ink column is cut quickly so that an amount of ejected ink can be reduced. Thus, by ejecting the fine ink droplets, an image of good quality with low granularity can be obtained.

A description will now be given of details of the driving waveform Pv, that is, the pulse widths Pw1 and Pw2 and the voltage values (peak values) Vp1 and Vp2 of the first and second driving signals P1 and P2 forming the driving waveform Pv, and the interval (the predetermined period of time) Td between the first and second driving signals P1 and P2 (or an application start timing Td of the second driving signal P2).

First, a description will be given, with reference to FIGS. 12 and 13, of the application start timing Td of the second driving signal P2.

Figure 12:
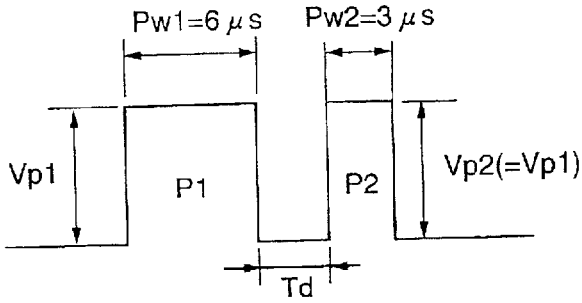
FIG. 12 is a diagram for illustrating a driving waveform according to the first embodiment.

As shown in FIG. 12, the ejection characteristics (the drop velocity Vj and the drop volume Mj) were measured in a case where the driving waveform Pv composed of the first and second driving signals P1 and P2 was applied to the electrode 55 with the predetermined period of time Td between the first and second driving signals P1 and P2 (the application start timing Td of the second driving signal P2) being varied.

Figure 13:
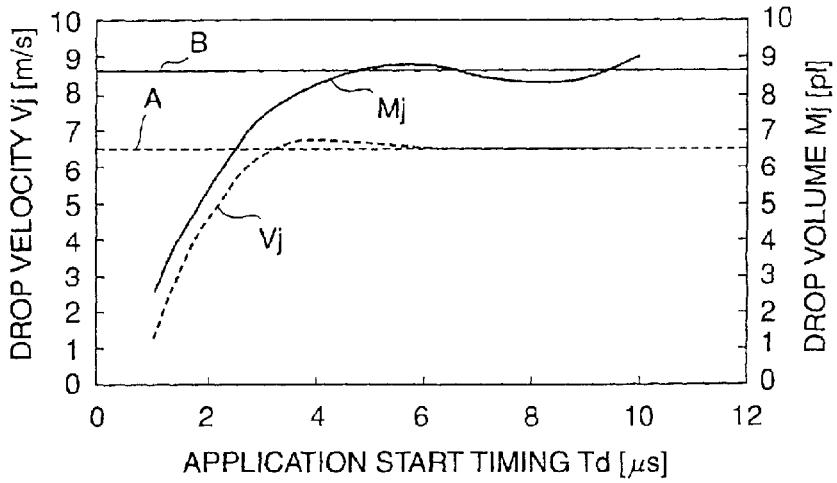
FIG. 13 is a diagram for illustrating a relation ship between an application start timing of a second driving signal and the drop velocity and drop volume when the driving waveform of FIG. 12 is applied.

At this time, as shown in the measurement results shown in FIG. 13, the drop velocity Vj and the drop volume (drop amount) Mj varied with respect to the application start timing Td as indicated by a curved broken line and a curved solid line, respectively. Further, the drop velocity Vj and the drop volume Mj of an ink droplet in the case of driving the ink jet head 40 by applying only the first driving signal P1 (such an ink droplet is called a normal ink droplet) took values as indicated by a broken straight line A and a broken straight line B in FIG. 13, respectively.

The driving waveform Pv for measuring the ejection characteristics was written to the ROM 71 with the first and second driving signals P1 and P2 and the predetermined period of time Td being grouped, and another driving waveform Pv was read out to change the predetermined period of time Td. Further, by referring to the case of FIG. 10, the first driving signal P1 had its pulse width Pw1 set to 6 μs and its voltage value Vp1 to 34 V so as to have good ejection efficiency and the second driving signal P2 had its pulse width Pw2 set to 3 μs and its voltage value Vp2 set to 34 V (=Vp1).

The measurement results show that by selectively determining the application start timing Td of the second driving signal P2, a fine ink droplet smaller than the normal ink droplet in droplet amount is ejectable. However, in this case, if the application start timing Td for ejecting the fine ink droplet satisfies a condition Td<2.5 μs, the drop velocity Vj is also smaller than that of the normal ink droplet. Therefore, with the application start timing Td that can secure the drop velocity Vj (that is, Td>3.5 μs), the drop volume Mj does not change greatly in amount. In the case shown in FIG. 13, the drop volume Mj can be changed only by ten-odd percent between 7.5 and 8.6 pl.

Therefore, only the fine ink droplet of a slow drop velocity Vj is ejectable by controlling only the application start timing Td. Considering a distance to be reserved between the sheet of paper 3 and the ink jet head 40 and the impact position accuracy of the ink droplet, it is preferable that the fine ink droplet be ejected at the drop velocity Vj of the normal ink droplet.

If the predetermined period of time (application start time) Td is thus short, the movement of the diaphragm 50 is controlled before a sufficient energy for ink ejection is delivered to the ink, thus decreasing the drop volume Mj, but with a reduced drop velocity Vj. Therefore, in order to secure a sufficient drop velocity Vj, it is preferable to delay the application start timing Td of the second driving signal P2, or extend the predetermined period of time Td, until the first driving signal P1 falls and the diaphragm 50 moves back to pass its equilibrium position shown in FIG. 11C. In this description, when a signal "falls or decays", this means that a signal "decreases in its absolute value" or "decreases to zero".

On the other hand, in the case of applying the second driving signal P2 to the electrode 55 after the diaphragm 50 reached the position furthest from the electrode 55 which position is indicated by the broken lines in FIG. 11D, it was found that the drop volume (ink droplet amount) was somewhat reduced since the ink was pulled back at an increased velocity, but that the drop volume Mj was prevented from changing greatly in amount.

From these points, it is preferable to start applying the second driving signal P2 at a timing between a timing at which the diaphragm 50 passes its equilibrium position (initial position) and a timing at which the diaphragm 50 reaches the position furthest from the electrode 55.

Thereby, sufficient ejection energy is delivered to the ink droplet to be ejected so that the sufficient drop velocity Vj can be maintained. Further, the second driving signal P2 prevents the diaphragm 50 from being vibrated by the pressure vibration and inertia of the pressure chamber 46 so that a fine ink column is formed by preventing extra ink from following the ink column and ink supply to the rear end of the ink column is cut immediately, thereby reducing an ink ejection amount (the drop volume Mj). The rear end of the ink column refers to a first end that is opposite to a second (front) end of the ink column which second end ejected earlier than the rear end from the nozzle 44 toward a recording medium on which the ink column is to be positioned. Front and rear ends of the ink droplet also have the same positional relation as described above.

Next, a description will be given, with reference to FIGS. 14 and 15, of an application period of time (the pulse width Pw2) of the second driving signal P2.

Figure 14:
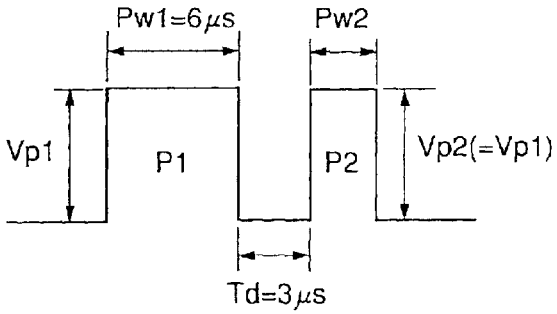
FIG. 14 is a diagram for illustrating the driving waveform according to the first embodiment.

As shown in FIG. 14, the ejection characteristics (the drop velocity Vj and the drop volume Mj) were measured in a case where the driving waveform Pv composed of the first and second driving signals P1 and P2 was applied to the electrode 55 with the pulse width P2 (the application period of time of the voltage value Vp2) of the second driving signal P2 being varied.

Figure 15:
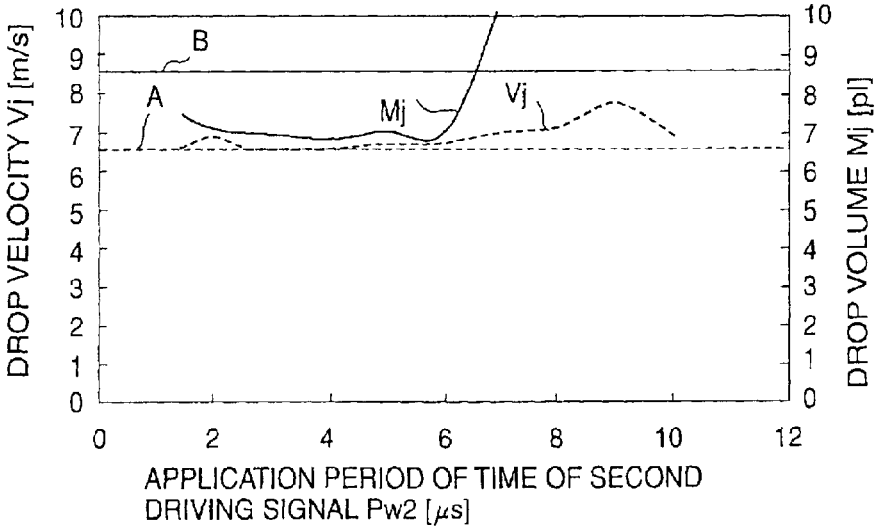
FIG. 15 is a diagram for illustrating a relationship between an application period of time of the second driving signal and the drop velocity and drop volume when the driving waveform of FIG. 14 is applied.

At this time, as shown in the measurement results shown in FIG. 15, the drop velocity Vj and the drop volume Mj varied with respect to the application period of time as indicated by a curved broken line and a curved solid line, respectively. Further, the drop velocity Vj and the drop volume Mj of the normal ink droplet in the case of driving the ink jet head 40 by applying only the first driving signal P1 took values as indicated by a broken straight line A and a broken straight line B in FIG. 15, respectively.

The driving waveform Pv for measuring the ejection characteristics was also written to the ROM 71 with the first and second driving signals P1 and P2 and the predetermined period of time Td being grouped, and another driving waveform Pv was read out to change the pulse width Pw. Further, by referring to the case of FIG. 10, the first driving signal P1 had its pulse width Pw1 set to 6 μs and its voltage value Vp1 to 34 V so as to have good ejection efficiency, the second driving signal P2 had its voltage value Vp2 set to 34 V (=Vp1), and the predetermined period of time (the application start timing) Td was set to 3 μs.

In this case, it was confirmed that if the pulse width Pw2 of the second driving signal P2 satisfied a condition Pw2>6 μs, the ink droplet was ejected at a very low velocity by the second driving signal P2 or the surface of the nozzle plate 43 was wetted by the ink droplet trickling down the surface. However, since the second driving signal P2 may be prevented from ejecting the ink droplet, for instance, by making the second driving signal P2 decay less sharply at its trailing edges, a limitation on the second driving signal P2 is not for micro-droplet ejection.

The measurement results show that if the pulse width Pw2 of the second driving signal P2 satisfies a condition Pw2≦6 μs, an ink droplet smaller than the normal ink droplet in the drop volume Mj is ejectable but the drop volume Mj does not change greatly by varying the pulse width Pw2.

Therefore, since the pulse width Pw2 (application period of time) of the second driving signal P2 has no direct relation to reduction of the ink droplet in size, it is not related to the reduction of the ink droplet to place the diaphragm 55 again in contact with the electrode 55 on application of the second driving signal P2.

However, when the diaphragm 50 is released from the electrode 55 with which the diaphragm 50 is in contact by making the second driving signal P2 fall, or by stopping application of the second driving signal P2, the diaphragm 50 tries to return to its equilibrium position by its restoring force, thus increasing the probability of ink droplet ejection. Accordingly, it is preferable to prevent an electrostatic force generated by the second driving signal P2 from causing the diaphragm 50 to retouch the electrode 55.

Therefore, by setting the pulse width Pw2 of the second driving signal P2 so that the second driving signal P2 decays, or the application of the second driving signal P2 is stopped, before the diaphragm 50 comes closest to the electrode 55 after ink droplet ejection, the diaphragm 50 is prevented from retouching the electrode 55, thereby preventing the second driving signal P2 from causing ink droplet ejection and ink droplet trickles.

In this case, by setting the pulse width Pw2 (application period of time) of the second driving signal P2 so that the second driving signal P2 falls, or the application of the second driving signal P2 is stopped, before the diaphragm 50 passes its equilibrium position (initial position) in a direction toward the electrode 55, the second driving signal P2 is more reliably prevented from causing ink droplet ejection and ink droplet trickles.

Particularly, in the case of using the second driving signal P2 that is a rectangular pulse signal as a second driving signal, it is preferable to set the pulse width Pw2 (application period of time) so that the second driving signal P2 falls before the diaphragm 50 passes its equilibrium position (initial position) in a direction toward the electrode 55.

That is, in the case of the electrostatic ink jet head, since the movement of the diaphragm 50 includes a suitable delay with respect to the voltage waveform, the diaphragm 5, unlike a piezoelectric body, is prevented from being damaged even if driven by rectangular pulses. Accordingly, a driving circuit may have as high rise and decay rates as. possible and there is no need to manage a value of resistance to set rise and decay time constants. As a driving circuit, a circuit configuration with "a time constant smaller than $\Delta t$" is easier than a circuit structure with "a time constant equal to $t0+\Delta t$". Therefore, it is preferable to use the rectangular pulses as a driving waveform.

Therefore, a driving signal generation part can be easily structured with switches without using a storage part (the ROM 81 and the D/A converter) as in this embodiment. Further, a driving circuit disclosed in Japanese Laid-Open Patent Application No. 9-254381 may be employed.

However, in the case of using the rectangular pulses, the diaphragm 50 is suddenly released only by causing the second driving signal P2 to decay. Therefore, if the diaphragm 50 is placed in contact with the electrode 55 by the second driving signal 55, the second driving signal P2 is more likely to cause ink droplet ejection. In order to avoid this, the second driving signal P2 is caused to fall before the diaphragm 50 comes closest to the electrode 55, or more preferably, before the diaphragm 50 passes its equilibrium position (initial position) in a direction toward the electrode 55, as previously described.

Next, a description will be given, with reference to FIGS. 16 and 17, of a relationship between the peak values Vp1 and Vp2 of the first and second driving signals P1 and P2.

Figure 16:
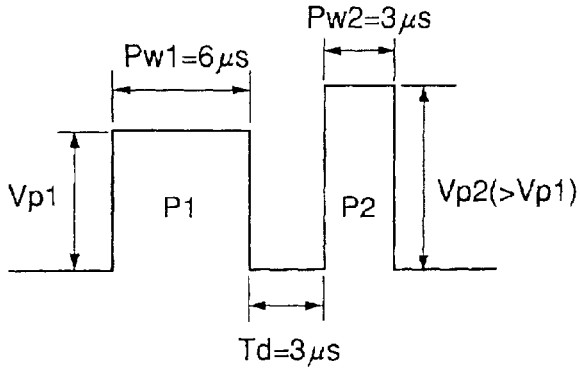
FIG. 16 is a diagram for illustrating the driving waveform according to the first embodiment.

As shown in FIG. 16, the ejection characteristics (the drop velocity Vj and the drop volume Mj) were measured in a case where the driving waveform Pv composed of the first and second driving signals P1 and P2 was applied to the electrode 55 with the peak value Vp2 of the second driving signal P2 being varied.

Figure 17:
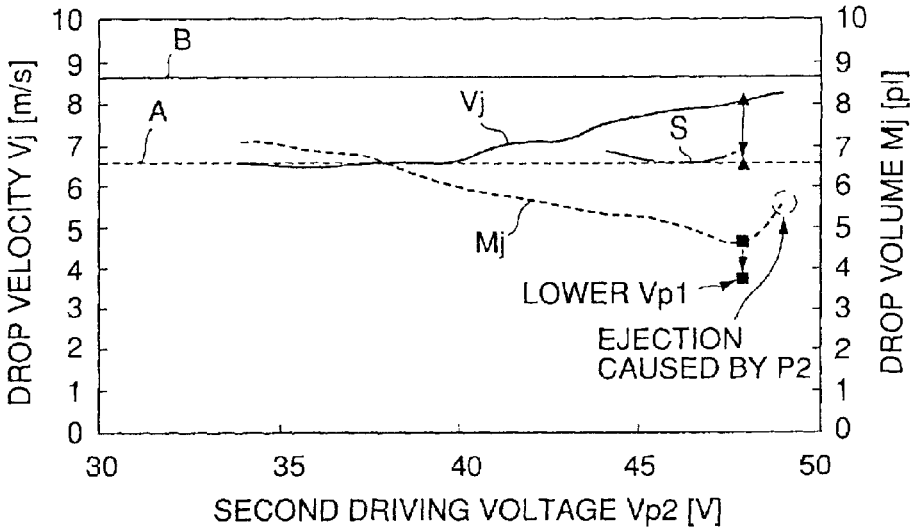
FIG. 17 is a diagram for illustrating a relationship between a voltage value of the second driving signal and the drop velocity and drop volume when the driving waveform of FIG. 16 is applied.

At this time, as shown in the measurement results shown in FIG. 17, the drop velocity Vj and the drop volume Mj varied with respect to the peak value Vp2 as indicated by a curved broken line and a curved solid line, respectively. Further, the drop velocity Vj and the drop volume Mj of the normal ink droplet in the case of driving the ink jet head 40 by applying only the first driving signal P1 took values as indicated by a broken straight line A and a broken straight line B in FIG. 17, respectively. Further, a satellite droplet, which was generated by increasing the peak value Vp2 of the second driving signal P2, had its drop velocity Vj varying as indicated by a double-dot chain line S in FIG. 17.

The driving waveform Pv for measuring the ejection characteristics was also written to the ROM 71 with the first and second driving signals P1 and P2 and the predetermined period of time Td being grouped, and another driving waveform Pv was read out to change the peak value Vp2. Further, by referring to the case of FIG. 10, the first driving signal P1 had its pulse width Pw1 set to 6 $\mu$s and its voltage (peak) value Vp1 to 34 V so as to have good ejection efficiency, the second driving signal P2 had its pulse width Pw2 set to 3 $\mu$s, and the predetermined period of time (the application start timing) Td was set to 3 $\mu$s.

The measurement results show that as the peak value (voltage value) Vp2 of the second driving signal P2 increases, the drop volume Mj decreases and the drop velocity Vj increases. As is not shown in FIG. 17, as the peak value Vp2 is reduced from 34 V, the drop volume Mj approaches 8.6 pl, which is the drop volume Mj of the normal ink droplet ejected in the case of driving the ink jet head 40 only by the first driving signal P1. Therefore, in this case, the drop volume Mj changes greatly in amount by 45% from 8.6 to 4.7 pl.

Thus, by setting the peak value Vp2 of the second driving signal P2 higher than the peak value Vp1 of the first driving signal for ejecting the normal ink droplet, deformation of the diaphragm 50 is more reliably controlled, so that a fine ink droplet smaller in volume by a great amount than the normal ink droplet is ejectable with the drop velocity Vj being maintained. That is, although it is technical common sense to set the peak value of a second driving signal (the second driving signal P2) lower than the peak value of a first driving signal (the first driving signal P1) for ink droplet ejection in order to prevent the second driving signal from causing ink droplet ejection, the present invention focuses on a structure specific to the electrostatic ink jet head and dares to upset the common sense by setting the peak value of the second driving signal higher than that of the first driving signal.

As previously described, if the application start timing Td of the second driving signal is set between the timing at which the diaphragm 50 passes its equilibrium position (initial position) and the timing at which the diaphragm reaches the furthest position from the electrode 55, a gap between the diaphragm 50 and the electrode 55 at that timing is wider than that at a timing at which the diaphragm 50 is in its equilibrium position. Therefore, the diaphragm 50 is moving away from the electrode 55 with inertia in this state.

In this case, an electrostatic force generated between the diaphragm 50 and the electrode 55 is inversely proportional to the square of a gap length. Therefore, in order to sufficiently control the movement of the diaphragm 50 in a position with the broadened gap, a desired electrostatic force is generated by setting the peak value Vp2 of the second driving signal P2 higher than the peal value Vp1 of the first driving signal P1.

As shown in FIG. 17, the second driving signal P2 caused ink droplet ejection when the peak value Vp2 thereof was set to 48 V. This is because the diaphragm 50 contacted the electrode 55 on application of the second driving signal P2. Therefore, depending on the peak value Vp2 of the second driving signal P2, it is preferable to control the driving waveform Pv by shortening the application period of time (the pulse width Pw2) of the second driving signal P2 to prevent the diaphragm 50 from contacting the electrode 55, or causing the second driving signal to fall slowly so that the second driving signal P2 causes no ink droplet ejection even if the diaphragm 50 contacts the electrode 55 as previously described.

Next, a description will be given, with reference to FIGS. 18 and 19 in addition to FIGS. 13 and 17, of a case where the peak value Vp2 of the second driving signal P2 is varied.

Figure 18:
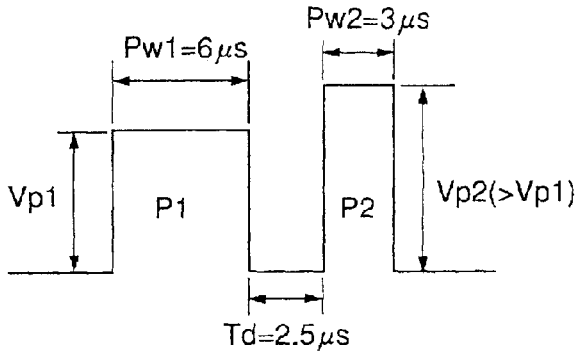
FIG. 18 is a diagram for illustrating the driving waveform according to the first embodiment.

As shown in FIG. 18, with the predetermined period of time Td between the first and second driving signals P1 and P2 being changed from 3 μs of FIG. 16 to 2.5 μs, the ejection characteristics (the drop velocity Vj and the drop volume Mj) were measured in a case where the driving waveform Pv composed of the first and second driving signals P1 and P2 was applied to the electrode 55 with the peak value Vp2 of the second driving signal P2 being varied.

Figure 19:
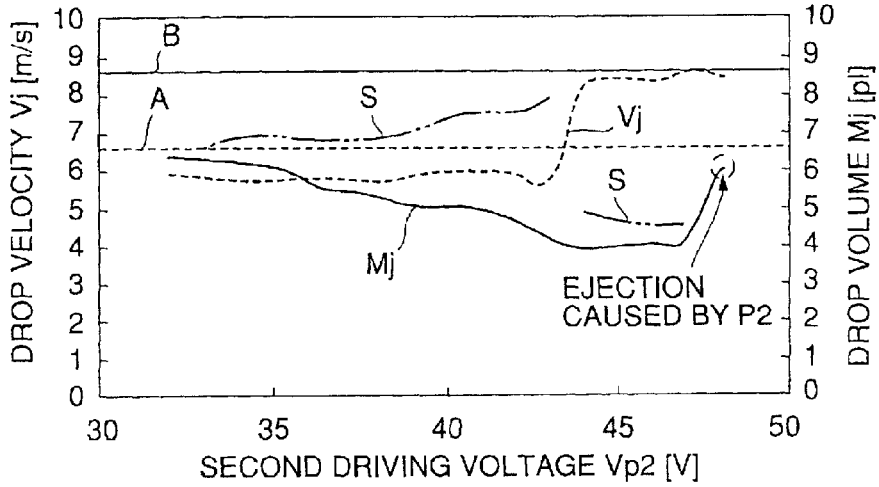
FIG. 19 is a diagram for illustrating a relationship between the voltage value of the second driving signal and the drop velocity and drop volume when the driving waveform of FIG. 18 is applied.

At this time, as shown in the measurement results shown in FIG. 19, the drop velocity Vj and the drop volume Mj varied with respect to the peak value Vp2 as indicated by a curved broken line and a curved solid line, respectively. Further, the drop velocity Vj and the drop volume Mj of the normal ink droplet in the case of driving the ink jet head 40 by applying only the first driving signal P1 took values as indicated by a broken straight line A and a broken straight line B in FIG. 19, respectively. Further, the satellite droplet had its drop velocity Vj varying as indicated by a double-dot chain line S in FIG. 19. That the drop velocity Vj crosses the drop velocity Vj (S) of the satellite droplet in FIG. 19 shows that the ejected droplet and the satellite droplet were reversed in size. In this case, if a plurality of ink droplets are ejected, the largest ink droplet in size is defined as a main droplet.

The driving waveform Pv for measuring the ejection characteristics was also written to the ROM 71 with the first and second driving signals P1 and P2 and the predetermined period of time Td being grouped, and another driving waveform Pv was read out to change the peak value Vp2. Further, as previously described, the first driving signal P1 had its pulse width Pw1 set to 6 μs and its voltage (peak) value Vp1 to 34 V so as to have good ejection efficiency, the second driving signal P2 had its pulse width Pw2 set to 3 μs, and the predetermined period of time (the application start timing) Td was set to 2.5 μs.

As can be seen from a comparison between the measurement results shown in FIGS. 17 and 19, if the predetermined period of time Td is set shorter, a rate of change in the drop volume Mj with the peak value Vp2 of the second driving signal P2 is larger. However, the satellite droplet is generated and a time difference between the main droplet and the satellite droplet is widened as the peak value Pw2 increases.

This is because the velocity of the ink droplet at its rear end (meaning the velocity of the satellite droplet if there is the satellite droplet) is decreased as the peak value Vp2 increases since the movement of the diaphragm 50 is controlled before sufficient ejection energy is delivered to the ink droplet. Generation of the satellite droplet or an increase in the time difference between the main droplet and the satellite droplet is not desirable in terms of a dot-shape and image quality.

This shows that it is better to set the predetermined period of time Td, independent of the drop volume Mj, at a timing at which the velocity of the ink droplet at its rear end (or the velocity of the satellite droplet) can be maintained.

Therefore, by controlling the drop volume Mj by setting variable the peak value Vp2 of the second driving signal P2, the second driving signal P2 is applicable at the timing at which the velocity of the ink droplet at its rear end (or the velocity of the satellite droplet) can be maintained, regardless of the drop volume Mj of the ink droplet to be ejected. The peak value Vp2 of the second driving signal P2 can be set variable by storing and reading data of the driving waveform which data includes peak values Vp2 within a predetermined range as previously described.

By varying the peak value Vp2 of the second driving signal P2 in accordance with an image to be recorded, an ejection amount of the fine ink droplet can be controlled within a wider range with the drop velocity Vj being maintained than by controlling the application start timing Td of the second driving signal P2.

Next, a description will be given of another case with respect to a setting of the application start timing Td of the second driving signal, or the predetermined period of time Td between the first and second driving signals.

In this case, the predetermined period of time Td that determines the application start timing of the second driving signal P2 is set from the measurement results shown in FIG. 13. In setting driving conditions, practically, it is difficult to determine the driving conditions while measuring the movement of the diaphragm 50. However, as illustrated in FIG. 19, an improper setting of the predetermined period of time Td causes a great effect on print quality while it may also cause a problem to set the predetermined period of time Td to a fixed value since there are variations in the finished ink jet heads 40 in a production process thereof.

Here, it has been discovered that with the peak values Vp1 and Vp2 of the first and second driving signals P1 and P2 being substantially equal (Vp1=Vp2), if the predetermined period of time Td is set to a period, or if the application start timing Td of the second driving signal is set to a timing, so that the velocity of the ink droplet at its rear end (the velocity of the satellite droplet if there is the satellite droplet) is substantially equal to the velocity of the normal ink droplet at its rear end (the velocity of the satellite droplet if there is the satellite droplet) ejected on application of only the first driving signal P1, the drop velocity Vj can be maintained even if the peak value Vp2 of the second driving signal P2 increases (see FIG. 17).

Thereby, without directly measuring the movement of the diaphragm 50, differences among the individual ink jet heads 40 due to production variation are corrected and the optimum predetermined period of time (application start timing of the second driving signal P2) Td can be set. Therefore, a beautiful dot with few scattered satellite droplets can be formed, thus increasing print quality.

Next, a description will be given of another setting of the application period of time (or the pulse width Pw2 in the case of pulses) of the second driving signal P2.

In this case, the application period of time (or the pulse width Pw2) is set longer than or equal to a quarter and shorter than three quarters of the peak time (peak span) of the pulse width characteristic of the ink droplet.

Figure 10:
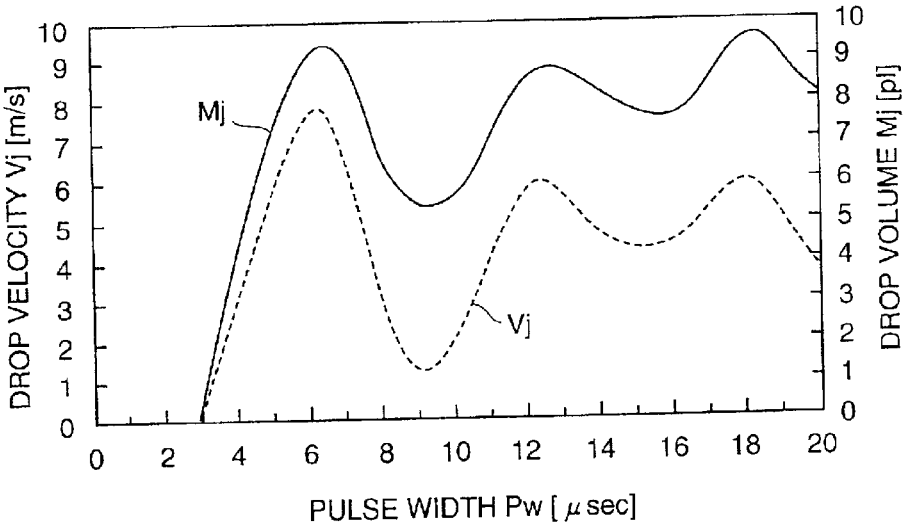
FIG. 10 is a diagram for illustrating a relationship between a pulse width of a driving waveform and a drop velocity and a drop volume in the ink jet head.

The pulse width characteristic shown in FIG. 10 reflects a superposition of the pressure vibrations at the rise time (when the diaphragm 50 is attracted toward the electrode 55 by an electrostatic force) and the decay time (when the diaphragm 50 is released) of the first driving signal P1. That is, the pressure vibrations generating peaks and valleys shown in FIG. 10 are related to the natural frequency of the pressure chamber (ink chamber) 46.

The basic vibration frequency of the diaphragm 50, which shifts to a somewhat shorter frequency depending on the magnitude of the voltage value Vp2 of the second driving signal P2, is deducible from the natural frequency of the pressure chamber 46, that is, the peaks and valleys of the pulse width characteristic of FIG. 10. Here, in order to prevent the diaphragm 50 from retouching the electrode 55 on application of the second driving signal P2, the application period of time (the pulse width Pw2) is set longer than or equal to a quarter and shorter than three quarters of the peak time (peak span) of the pulse width characteristic of the ink droplet.

Thereby, without directly measuring the movement of the diaphragm 50, differences among the individual ink jet heads 40 due to production variation are corrected and the optimum application period of time (the pulse width Pw2) of the second driving signal P2 can be set.

Next, a description will be given, with reference to FIGS. 20 through 23, of other examples of the driving waveform Pv applied to the ink jet head 40.

Figure 20:
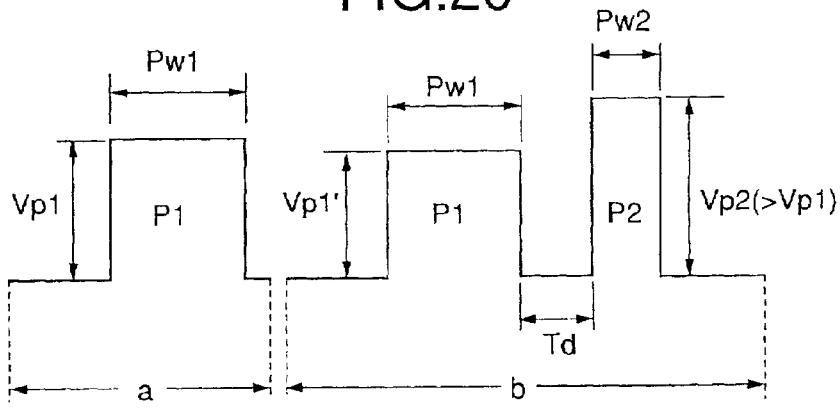
FIG. 20 is a diagram for illustrating another example of the driving waveform according to the first embodiment.

The driving waveform Pv of FIG. 20 has the peak value Vp1 and the pulse width Pw1 when the normal ink droplet is ejected by applying only the first driving signal P1 as shown in part a of FIG. 20 and has a peak value Vp1' (Vp1'<Vp1) and the pulse width Pw1 when the fine ink droplet is ejected by applying the first and second driving signals P1 and P2 as shown in part b of FIG. 20.

In other words, as shown in FIG. 17, as the peak value Vp2 of the second driving signal P2 increases, the drop volume Mj decreases and the drop velocity Vj increases. This is because a decrease in the drop volume Mj causes kinetic energy provided by the first driving signal P1 to be reflected in the drop velocity Vj.

It is preferable in terms of the impact position accuracy of the ink droplet that the drop velocity Vj be a constant value. Therefore, the peak value Vp1' of the first driving signal for ejecting the fine ink droplet by applying the first and second driving signals P1 and P2 is set lower than the peak value Vp1 for applying only the first driving signal P1 (Vp1>Vp1').

Thereby, the drop volume Mj is further reduced, thus forming a finer dot. Further, granularity is lowered and the quality of a printed image is increased. Since a slight increase in the drop velocity Vj exerts little influence on a dot diameter and image quality, it is not necessary to force the drop velocity Vj to be reduced.

Figure 21:
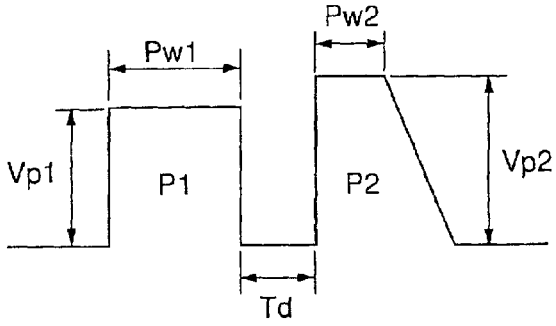
FIG. 21 is a diagram for illustrating another example of the driving waveform according to the first embodiment.

Next, the driving waveform Pv of FIG. 21 includes the second driving signal P2 having its decay change rate lowered, or having its decay time constant tf increased.

In order to eject a finer ink droplet by using the peak value Vp2 of the second driving signal P2, it is required to raise the peak value Vp2 further. However, in the case of FIG. 17, the ink droplet ejection has already started at the peak value Vp2 of 48 V. This is because the diaphragm 50 contacted the electrode 55 on application of the second driving signal P2. Therefore, in order to eject the finer ink droplet, it is necessary to form the second driving signal P2 that causes no ink droplet ejection even if the diaphragm 50 contacts the electrode 55.

Further, even if the diaphragm 50 does not contact the electrode 55, pressure vibrations are superposed when an ejection frequency is increased, thus causing an ink trickle. Therefore, it is preferable to reduce as much as possible a pressure vibration inside the pressure chamber 46 caused by the second driving signal P2.

By causing the second driving signal P2 to have a lower decay change rate, the pressure vibration inside the pressure chamber 46 is reduced, and the second driving signal P2 is prevented from causing ink droplet ejection or an ink trickle even if the ink jet head 40 is driven at a high frequency. Further, since ink drop ejection or an ink trickle hardly occurs on application of the second driving signal P2, the peak value Pw2 of the second driving signal P2 can be set higher, thereby enabling ejection of the finer ink droplet. This lowers granularity and increases the quality of a printed image.

Figure 22:
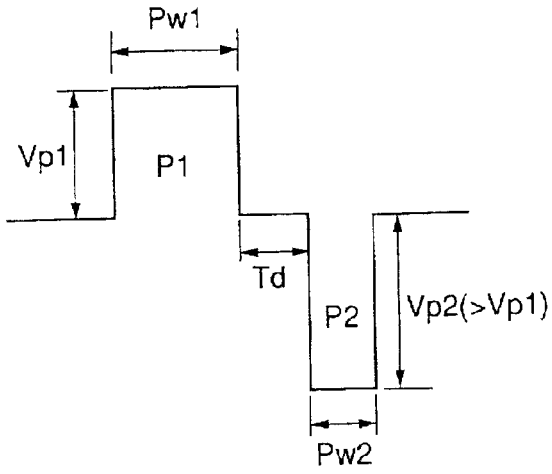
FIG. 22 is a diagram for illustrating another example of the driving waveform according to the first embodiment.

Next, the driving waveform Pv of FIG. 22 includes the first and second driving signals P1 and P2 that are reversed in polarity with respect to each other.

That is, in the case of the electrostatic ink jet head, residual electric charges may accumulate on the electrode protection film 57 in some cases. Accumulation of the residual electric charges reduces effective electric field strength, thus preventing stable ink droplet ejection. It is considered that the residual electric charges are caused by residual polarization, field emission, or electrification by tunnel effect of the electrode protection film 57.

Therefore, by reversing the second driving signal P2 in polarity with respect to the first driving signal P1, the accumulation of the residual electric charges is prevented and a variation in electrostatic force is reduced, and accordingly, stable ejection of the fine ink droplets can be realized and image quality can be increased with lowered granularity. In this case, since the same waveform may be employed in each driving cycle, drive control is easily performed.

Figure 23:
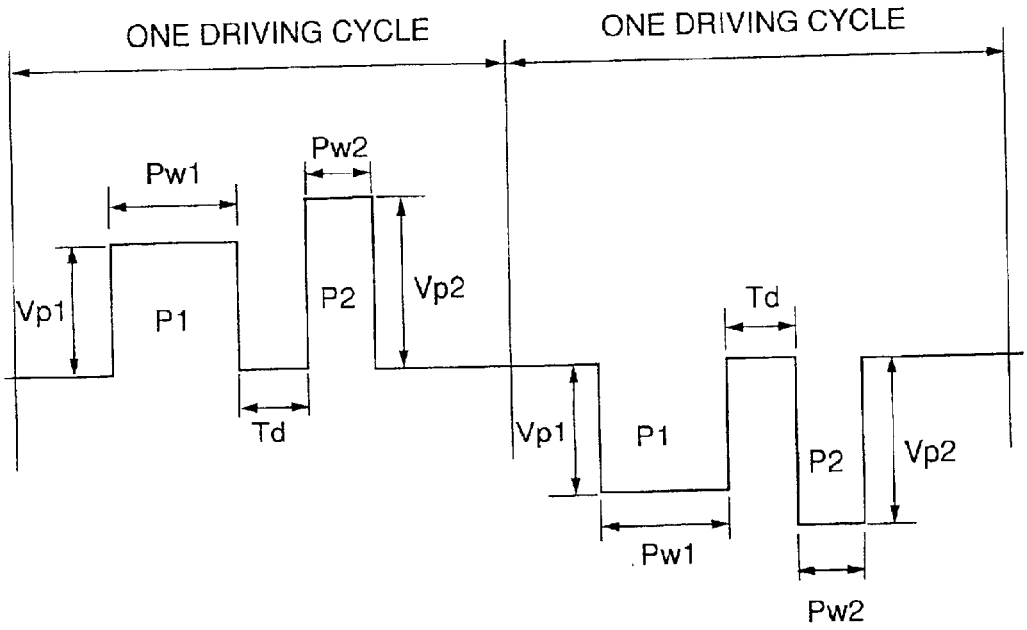
FIG. 23 is a diagram for illustrating another example of the driving waveform according to the first embodiment.

Next, the driving waveform of FIG. 23 includes the first and second driving signals P1 and P2 that are periodically reversed in polarity. In this case, each of the first and second driving signals P1 and P2 has its polarity reversed every driving cycle, but the polarity may be reversed once in a predetermined number of driving cycles.

As in the above-described case, this has the effect of preventing the accumulation of the residual electric charges on the electrode protection film 57. The way the residual electric charges accumulate varies depending on whether the diaphragm 50 is in or out of contact with the electrode 55. In the case of the diaphragm 50 being out of contact with the electrode 55, the way residual electric charges accumulate varies depending on a distance between the diaphragm 50 and the electrode 55, and the distance may vary due to a change in ink viscosity caused by ambient temperature. Therefore, in the case of preventing the second driving signal P2 from causing the diaphragm 50 to contact the electrode 55, it erases the residual electric charges more stably to reverse the polarity of the entire driving waveform Pv including the first driving signal P1.

Since the contact of the diaphragm 50 with the electrode 55 on application of the second driving signal P2 is to be avoided whenever possible according to the present invention, this prevents the accumulation of the residual electric charges more reliably than to only reverse the polarity of the second driving signal P2 as previously described.

Figure 24:
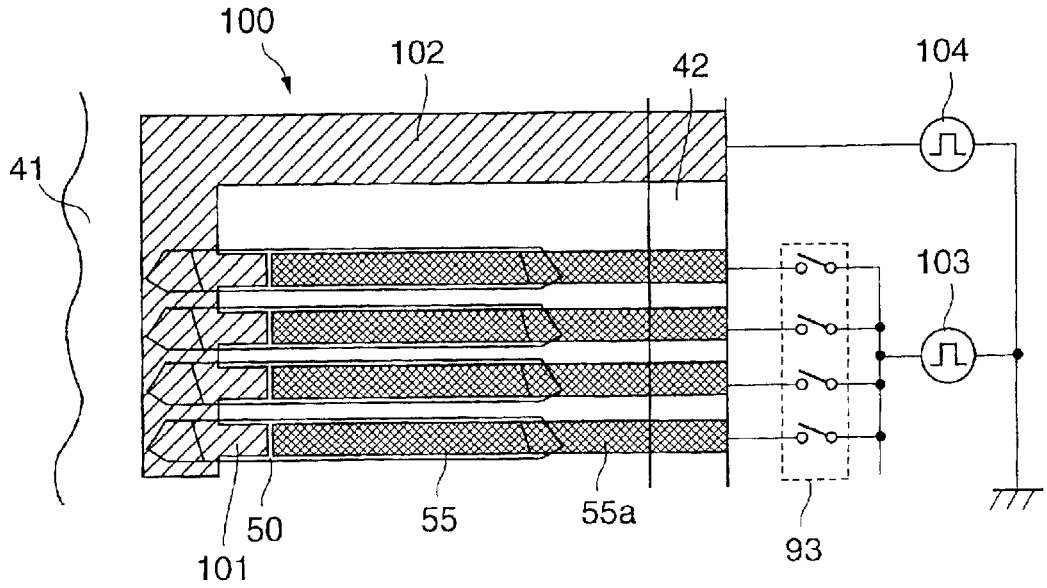
FIG. 24 is a plan view of a principal part of an ink jet head according to a second embodiment of the present invention.
Figure 25:
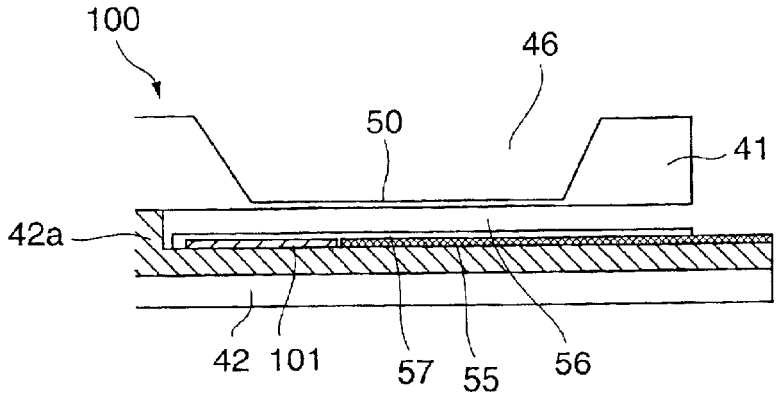
FIG. 25 is a sectional view of the ink jet head of FIG. 24 taken along the length of the diaphragm of the ink jet head.

Next, a description will be given, with reference to FIGS. 24 through 26, of a second embodiment of the present invention. FIG. 24 is a plan view of a principal part of an ink jet head 100 of this embodiment and FIG. 25 is a sectional view of the ink jet head 100 taken along the length of each diaphragm 50 or a direction in which each diaphragm extends. In the drawings, the same elements as those of the ink jet head 40 of the first embodiment are referred to by the same numerals, and a description thereof will be omitted.

The ink jet head 100 includes third electrodes 101 to which the second driving signal P2 is applied. The third electrodes 101 are formed on the same plane as the electrodes 55 so as to oppose the corresponding diaphragms 50 and are connected to a common part 102.

According to this embodiment, the first driving signal P1 is applied to the electrodes 55 of the ink jet head 100 via the driver IC 93 from a first driving signal generation circuit 103 and a second driving signal P2 is applied to the third electrodes 101 from a second driving signal generation circuit 104.

As shown in FIG. 26A, the first driving signal generation circuit 103 generates and outputs the first driving signal P1 having the peak value Vp1 and the pulse width Pw1. The second driving signal generation circuit 104, as shown in FIG. 26B, generates and outputs the second driving signal P2 having the peak value Vp2 and the pulse width Pw2 at a timing delayed by the predetermined period of timing Td with respect to the first driving signal P1, that is, from the end of application of the first driving signal P1.

According to this structure, the first driving signal P1 is applied to the electrodes 55 so that electrostatic forces are generated between the diaphragms 50 and the electrodes 55, and then the second driving signal P2 for controlling the movements of the diaphragms 50 is applied to the third electrodes 101, thereby generating electrostatic forces between the diaphragms 50 and the third electrodes 101 so that ink droplets are ejected.

In the case of applying first and second driving signals in different electrical paths as described above, it is no more required to complete charge and discharge during a predetermined short period of time between the first and second driving signals. Therefore, a driver IC may have its ON resistance increased as far as influence caused by the increase on ink ejection caused by the first driving signal is kept small, thus decreasing the costs of the driver IC. Further, since the first and second driving signals may be generated independently from each other (although synchronization between the signals is required), a driving signal generation part may be formed by a simple structure. As in the above-described embodiment, the fine ink droplets are ejectable by controlling the movements of the diaphragms 50 by applying the second driving signal PV2.

A description will now be given, with reference to FIG. 27, of a variation of the second embodiment of the present invention. According to this variation, the electrode substrate 42 formed of a silicon substrate serves as a third electrode to which the second driving signal P2 for controlling the movements of the diaphragms 50 is applied, and the first driving signal P1 for ink ejection is applied to the electrodes 55.

Since an electrode substrate is thus employed as a third electrode, it is no more required to form a special electrode pattern, thus simplifying a head structure. Further, since electrostatic force is exerted on all the surfaces of the diaphragms, influence on ink droplets is magnified. However, the diaphragms are further from the electrode substrate in distance than from electrodes, it is necessary to increase a voltage value of the second driving signal compared with the case where the second driving signal is applied to the electrodes or to the third electrodes formed on the same plane as the electrodes.

Next, a description will be given, with reference to FIGS. 28 and 29, of another variation of the second embodiment. An ink jet head 110 according to this variation includes third electrodes 111 to which the second driving signal P2 is applied. The third electrodes 111 are formed on the side of the nozzles 44 on the same plane as the electrodes 55 so as to extend outward as the electrodes 55. The third electrodes 111 are collectively connected through interconnection lines patterned on the FPCs for drawing electrodes to the second driving signal generation part 104.

According to this variation, the first driving signal P1 is applied to the electrodes 55 of the ink jet head 110 via the driver IC 93 from the first driving signal generation circuit 103 and the second driving signal P2 is applied to the third electrodes 111 from the second driving signal generation circuit 104.

As shown in FIG. 26A, the first driving signal generation circuit 103 generates and outputs the first driving signal P1 having the peak value Vp1 and the pulse width Pw1. The second driving signal generation circuit 104, as shown in FIG. 26B, generates and outputs the second driving signal P2 having the peak value Vp2 and the pulse width Pw2 at a timing delayed by the predetermined period of timing Td with respect to the first driving signal P1.

Figure 28:
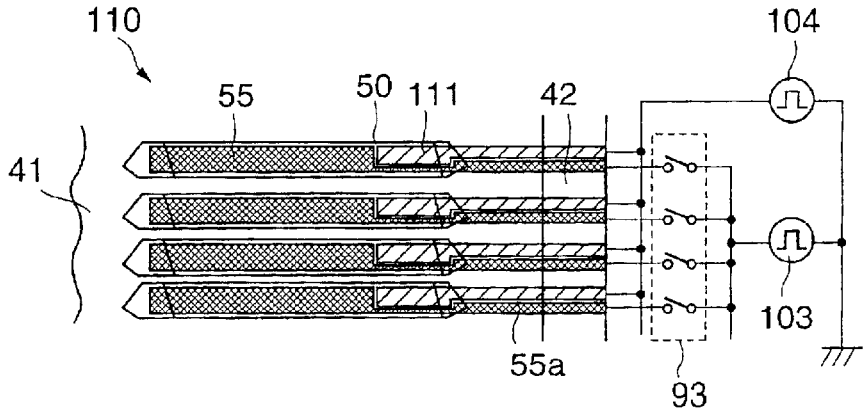
FIG. 28 is a diagram for illustrating another variation of the second embodiment.
Figure 29:
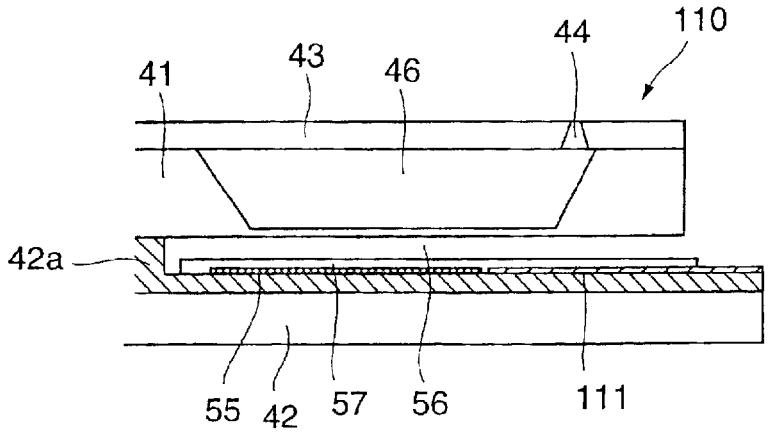
FIG. 29 is a sectional view of an ink jet head according to the variation of FIG. 28 taken along the length of the diaphragm of the ink jet head.

In the case of thus forming third electrodes so that the third electrodes are included in individual electrodes in terms of formation area as shown in FIG. 28, by forming the third electrodes in areas opposing diaphragms only in areas corresponding to the neighboring areas of nozzles, that is, by forming the third electrodes in areas closer to the nozzles, the movements of the diaphragms are effectively controlled in areas close to the nozzles. Therefore, each ink droplet ejection is stopped quickly so that finer ink droplets are ejectable.

Figure 31:
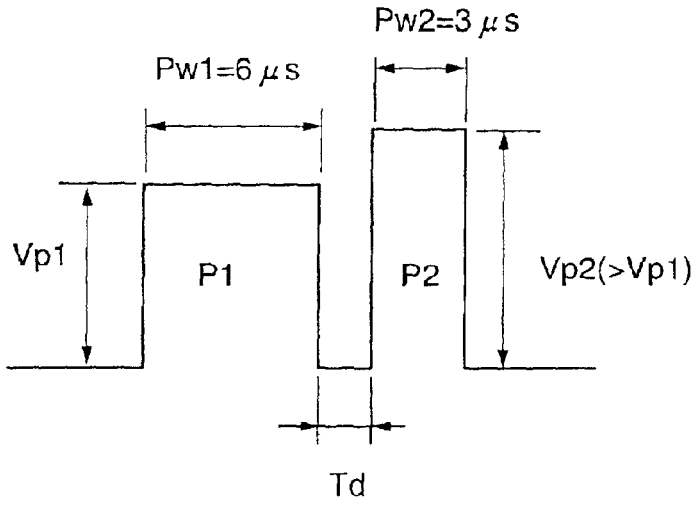
FIG. 31 is a diagram for illustrating a driving waveform according to the third embodiment.
Figure 32:
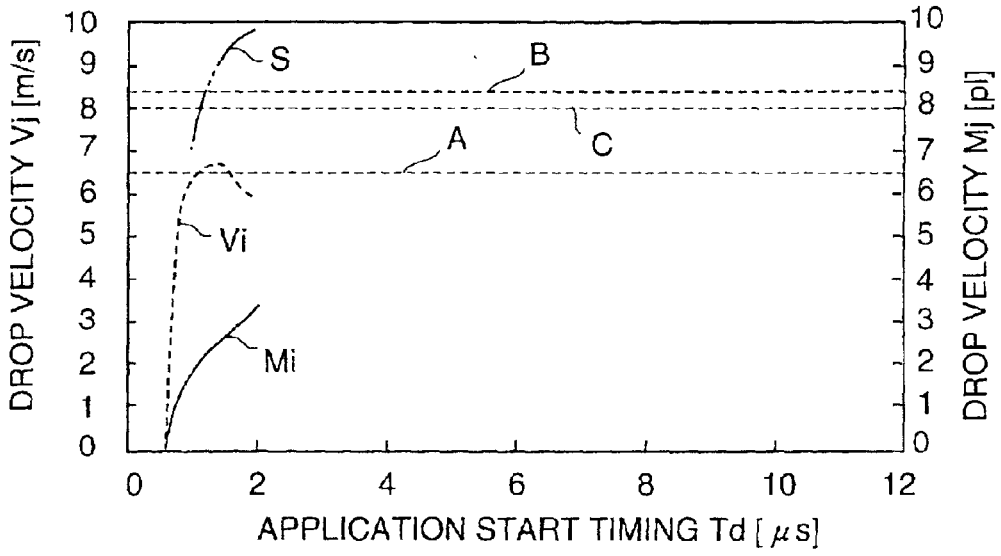
FIG. 32 is a diagram for illustrating a relationship between an application start timing of the second driving signal and the drop velocity and drop volume when the driving waveform of FIG. 31 is applied.

Next, a description will be given, with reference to FIGS. 30A through 32 of a third embodiment of the present invention. FIGS. 30A through 30E are diagrams for illustrating a movement or operation of each diaphragm 50 according to this embodiment. FIG. 31 is a diagram for illustrating the driving waveform Pv according to this embodiment. FIG. 32 is a diagram for illustrating a relationship between the application start timing of the second driving signal P2 and the ink droplet ejection characteristics according to this embodiment. In the following description, the same elements as those described in the above-described embodiments are referred to as the same numerals.

According to this embodiment, the diaphragms 50 contact the electrodes 55 on application of the first driving signal P1. Then, with the predetermined period of time Td between the first and second driving signals P1 and P2 being set short, the second driving signal P2 is applied to the electrodes 55 at a timing before the diaphragms 50 return to their initial positions with the application of the first driving signal P1 being stopped. Thereby, satellite droplets are ejected before main droplets, thereby ejecting fine ink droplets.

Figure 30A:
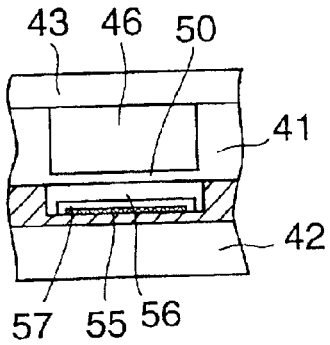
FIGS. 30A through 30E are diagrams for illustrating an operation of the diaphragm according to a third embodiment of the present invention.
Figure 30D:
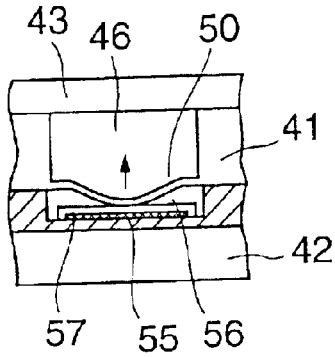
Figure 30B:
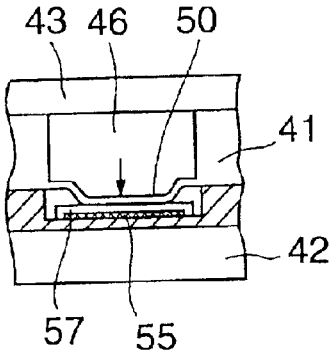
Figure 30E:
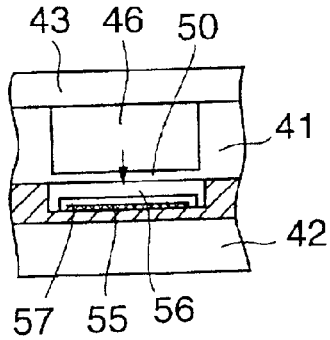

This operation is illustrated by FIGS. 30A through 30E. First, as shown in FIG. 30A, the diaphragm 50 is in its equilibrium position (initial position) with no driving waveform Pv being applied. In this state, when the first driving signal P1 is applied to the electrode 55, an electrostatic force is generated between the diaphragm 50 and the electrode 55 to deform the diaphragm 50 toward the electrode 55 so that the diaphragm 50 contacts the electrode 55 (the surface of the electrode protection film 57) as shown in FIG. 30B. At this point, if the driving waveform Pv increases, the contact area of the diaphragm 50 and the electrode 55 increases so that greater energy is stored.

Figure 30C:
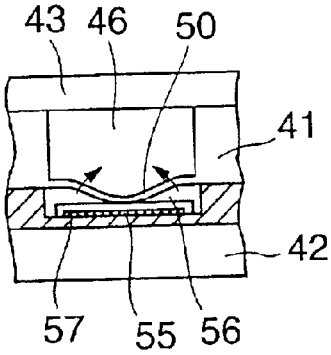

Then, by releasing the diaphragm 50 by causing the first driving signal P1 to fall so that the application of the first driving signal P1 is stopped, the diaphragm 50 suddenly causes its parts having a high deformation curvature, that is, end parts of its part contacting the electrode 55, to start restoration to their original positions as shown in FIG. 30C.

This sudden restorative deformation of the diaphragm 50 generates a pressure wave, and energy for ejecting the satellite droplet (called "a prior satellite droplet" since having a larger velocity than the main drop) is generated before the diaphragm 50 returns to its equilibrium position, that is, before the main drop is ejected, thereby causing the satellite droplet finer in size than the main droplet to be ejected from the nozzle 44.

Thereafter, as shown in FIG. 30D, the diaphragm 50 tries to return to its equilibrium position without having any of its parts being deformed to a large extent. Therefore, by applying the second driving signal P2 to the electrode 55 at this timing, the restoring force of the diaphragm 50 is weakened, and as shown in FIG. 30E, the diaphragm 50 returns to its equilibrium position slowly. Thus, energy for ejecting the ink droplet (main droplet) is lost so that no main droplet is ejected from the nozzle 44. In this case, the peak value Pw2 of the second driving signal P2 is set higher than the peak value Pw1 of the first driving signal P1.

Thus, in the case of ejecting the satellite droplet as a fine droplet by using the initial restoration start pressure of the diaphragm 50 contacting the electrode 55, the prior satellite droplet has a sufficient velocity so that dot positioning is performed with little deviation. Further, since the prior satellite droplet is considerably smaller in size than the main droplet, granularity can be lowered.

A description will be given, with reference to FIGS. 31 and 32, of the first and second driving signals P1 and P2 and the predetermined period of time Td of this case.

As shown in FIG. 31, the ejection characteristics (the drop velocity Vj and the drop volume Mj) were measured in a case where the driving waveform Pv composed of the first and second driving signals P1 and P2 was applied to the electrode 55 with the predetermined period of time Td between the first and second driving signals P1 and P2 (the application start timing Td of the second driving signal P2) being varied between 0.5 and 2.0 μs.

At this time, as shown in the measurement results shown in FIG. 32, the drop velocity Vj and the drop volume Mj varied with respect to the application start timing Td as indicated by a curved broken line and a curved solid line, respectively, and the drop velocity Vj of the prior satellite droplet varied as indicated by a double-dot chain line S. Further, in the case of applying only the first driving signal P1 to the electrode 55 for driving an ink jet head according to this embodiment (any of the ink jet heads 40, 100, and 110 of the above-described embodiments), the drop velocity Vj and the drop volume Mj of the main droplet took values as indicated by a broken straight line A and a broken straight line B, respectively, and the drop velocity of the satellite droplet took values as indicated by a broken line C in FIG. 32.

The driving waveform Pv for measuring the ejection characteristics was written to the ROM 71 with the first and second driving signals P1 and P2 and the predetermined period of time Td being grouped, and another driving waveform Pv was read out to change the predetermined period of time Td. Further, by referring to the case of FIG. 10, the first driving signal P1 had its pulse width Pw1 set to 6 μs and its voltage value Vp1 so as to have good ejection efficiency and the second driving signal P2 had its pulse width Pw2 set to 3 μs and its voltage value Vp2 higher than the voltage value Vp1 (Vp2>Vp1).

With respect to the structure of the ink jet head of this embodiment, each pressure chamber was set to 800 μm in length, each diaphragm 50 was set to 2 μm in thickness, and each nozzle was set to 20 μm in diameter in the head structure of the above-described embodiment, thereby increasing fluid resistance to some extent. This is because the prior satellite droplets are more easily generated by increasing the fluid resistance by decreasing each nozzle diameter since an increase in the fluid resistance prevents ink from flowing smoothly, thus causing the ink to follow slowly.

The measurement results show that ejection of only the prior satellite droplet can be performed by applying the second driving signal P2 at an extremely short interval of the predetermined period of time Td from the release of the diaphragm 50 caused by applying the first driving signal P1 to the electrode 55.

In this case, since there exist the residual pressure of the pressure chamber 46 generated at the time of applying the first driving signal P1 and the kinetic energies of the ink and the diaphragm 50 generated at the time of releasing the diaphragm 50, the peak value Pw2 of the second driving signal P2 is set higher than the peak value Pw1 of the first driving signal P1 in order to cause the diaphragm 50 to return slowly, that is, in order to prevent the ink droplet from being ejected. Thereby, only a preceding fine droplet (the prior satellite droplet) is ejectable without ejection of the main droplet.

In the case of applying the second driving signal P2 before the diaphragm 50 returns to its equilibrium position, as shown in FIG. 32, it is preferable to perform gradation control by changing the predetermined period of time (the application start timing) Td. Thereby, a dot diameter is stably controllable.

In each of the above-described embodiments, the diaphragms 50 and electrodes 55 of the electrostatic ink jet head each 40, 100, or 110 have a rectangular planar shape, but may have a trapezoidal or triangular planar shape. Further, each of the ink jet head 40, 100, and 110 of the above-described embodiments has the diaphragms 50 and the pressure chambers 46 formed of the same member of the channel substrate 41, but the diaphragms 50 and the pressure chambers 46 may be formed of different members that are to be joined after the formation of the diaphragms 50 and the pressure chambers 46.

Further, the nozzles 44, the pressure chambers 46, the fluid resistance parts 47, and the common liquid chamber channel 48 of each of the ink jet heads 40, 100, and 110 can be properly changed in their shapes, dispositions, and formation methods. For instance, in the above-described embodiments, the ink jet head 40, 100, and 110 are of a side-shooter type where nozzles are formed so as to eject ink droplets in a direction in which diaphragms are deformed. However, the ink jet head 40, 100, and 110 may be of an edge-shooter type where nozzles are formed so as to eject ink droplets in a direction perpendicular to a direction in which diaphragms are deformed.

The present invention is not limited to the specifically disclosed embodiments, but variations and modifications may be made without departing from the scope of the present invention.

The present application is based on Japanese priority application No. 2000-289727 filed on Sep. 25, 2000, the entire contents of which are hereby incorporated by reference.

What is claimed is:

1. An ink jet recording apparatus comprising:

an ink jet head including a nozzle for ejecting an in droplet, an ink channel communicating with the nozzle, a diaphragm forming a part of wall faces of the ink channel, and an electrode opposing the diaphragm, the diaphragm being deformed by electrostatic force so that the ink droplet is ejected from the nozzle; and a part applying to said ink jet head a first driving signal for generating the electrostatic force for ejecting the ink droplet from the nozzle and a second driving signal for controlling deformation of the diaphragm, the second driving signal being applied after a predetermined period of time passes since application of the first driving signal, wherein in response to the first driving signal, the diaphragm is deformed toward the electrode and when the first driving signal is removed, the diaphragm deforms in a direction away from the electrode so that the ink droplet is ejected from the nozzle, the second driving signal being applied at a time when the diaphragm is moving in the direction away from the electrode, wherein the first and second driving signals are applied so as to eject a same ink droplet, the second driving signal reduces a volume of ink to be ejected by the first driving signal, and the second driving signal is prevented from causing the diaphragm to come into contact with the electrode.

2. The ink jet recording apparatus as claimed in claim 1, wherein the second driving signal is applied to the electrode.

3. The ink jet recording apparatus as claimed in claim 1, wherein:

the ink jet head further includes an additional electrode opposing the diaphragm and electrically separated from the electrode; and the second driving signal is applied to the additional electrode.

4. The ink jet recording apparatus as claimed in claim 1, wherein the second driving signal is applied to a substrate on which the electrode is formed.

5. The ink jet recording apparatus as claimed in claim 1, wherein application of the second driving signal is stopped at a timing before the diaphragm contacts the electrode.

6. The ink jet recording apparatus as claimed in claim 5, wherein the application of the second driving signal is stopped before the diaphragm passes the equilibrium position in a direction toward the electrode.

7. The ink jet recording apparatus as claimed in claim 1, wherein the second driving signal is a rectangular pulse signal.

8. The ink jet recording apparatus as claimed in claim 1, wherein the second driving signal has a decay change rate lower than that of the first driving signal.

9. The ink jet recording apparatus as claimed in claim 1, wherein the second driving signal has a peak value higher than that of the first driving signal.

10. The ink jet recording apparatus as claimed in claim 1, wherein a peak value of the second driving signal is variable.

11. The ink jet recording apparatus as claimed in claim 1, wherein:

the first and second driving signals have substantially equal peak values; and the second driving signal is applied at a timing at which a velocity of a rear end of the ink droplet ejected on application of the second driving signal is substantially equal to a velocity of the rear end of the ink droplet ejected by applying only the first driving signal.

12. The ink jet recording apparatus as claimed in claim 1, wherein the second driving signal is applied for period of time longer than or equal to a fourth of a peak span of a pulse width characteristic of the ink droplet and shorter than three fourths of the peak span.

13. The ink jet recording apparatus as claimed in claim 1, wherein application of both of the first and second driving signals or application of only the first driving signal is selectable.

14. The ink jet recording apparatus as claimed in claim 1, wherein a peak value of the first driving signal is smaller in a case of applying both of the first and second driving signals than in a case of applying only the first driving signal.

15. The ink jet recording apparatus as claimed in claim 1, wherein the second driving signal has a polarity opposite to that of the first driving signal.

16. The ink jet recording apparatus as claimed in claim 1, wherein the first and second driving signals are reversed in polarity every driving cycle or once in a predetermined number of driving cycles.

17. The ink jet recording apparatus as recited in claim 1, wherein the second driving signal is applied at a time when the diaphragm is moving in the direction away from the electrode so that the diaphragm does not reach its potentially furthest distance away from the electrode.

18. An ink jet recording apparatus comprising:

an ink jet head including a nozzle for ejecting an ink droplet, an ink channel communicating with the nozzle, a diaphragm forming a part of wall faces of the ink channel, and an electrode opposing the diaphragm, the diaphragm being deformed by electrostatic force so that the ink droplet is ejected from the nozzle; and a part applying to said ink jet head a first driving signal for generating the electrostatic force for ejecting the ink droplet from the nozzle and a second driving signal for controlling deformation of the diaphragm, the second driving signal being applied after a predetermined period of time passes since application of the first driving signal, wherein in response to the first driving signal, the diaphragm is deformed toward the electrode and when the first driving signal is removed, the diaphragm deforms in a direction away from the electrode so that the ink droplet is ejected from the nozzle, the second driving signal being applied at a time when the diaphragm is moving in the direction away from the electrode, wherein the first and second driving signals are applied so as to eject a same ink droplet, the second driving signal reduces a volume of ink to be ejected by the first driving signal, and the second driving signal is applied to said ink jet head at a timing between a timing at which the diaphragm passes an equilibrium position thereof in a direction away from the electrode and timing at which the diaphragm reaches a position furthest from the electrode.

19. A head drive and control device for driving and controlling an ink jet head including a nozzle for ejecting an ink droplet, an ink channel communicating with the nozzle, a diaphragm forming a part of wall faces of the ink channel, and an electrode opposing the diaphragm, the diaphragm being formed by electrostatic force so that the ink droplet is ejected from the nozzle, the head drive and control device comprising:

a first part applying to said ink jet head a first driving signal for generating the electrostatic force for ejecting the ink droplet from the nozzle and a second driving signal for controlling deformation of the diaphragm, the second driving signal being applied after a predetermined period of time passes since application of the first driving signal, wherein in response to the first driving signal, the diaphragm is deformed toward the electrode and when the first driving signal is removed, the diaphragm deforms in a direction away from the electrode so that the ink droplet is ejected from the nozzle, the second driving signal being applied at a time when the diaphragm is moving in the direction away from the electrode, wherein the first and second driving signals are applied so as to eject a same ink droplet, and the second driving signal reduces a volume of ink to be ejected by the first driving signal, and wherein the second driving signal is prevented from causing the diaphragm to come into contact with the electrode.

20. The head drive and control device as claimed in claim 19, further comprising a second part generating the first and second driving signals in time series.

21. The head drive and control device as claimed in claim 19, wherein the second driving signal decays before the diaphragm passes an equilibrium position thereof in a direction toward the electrode when the second driving signal is applied to the ink jet head.

22. The head drive and control device as claimed in claim 19, wherein the first and second driving signals are rectangular pulse signals.

23. The head drive and control device as claimed in claim 19, wherein the second driving signal has a peak value higher than that of the first driving signal.

24. The head drive and control device as claimed in claim 19, wherein the second driving signal has a polarity opposite to that of the first driving signal.

25. The head drive and control device as claimed in claim 19, wherein the first and second driving signals are reversed in polarity every driving cycle or once in a predetermined number of driving cycles.

26. The device as recited in claim 19, wherein the second driving signal is applied at a time when the diaphragm is moving in the direction away from the electrode so that the diaphragm does not reach its potentially furthest distance away from the electrode.

27. A head drive and control device for driving and controlling an in jet head including a nozzle for ejecting an ink droplet, an ink channel communicating with the nozzle, a diaphragm forming a part of wall faces of the ink channel, and an electrode opposing the diaphragm, the diaphragm being deformed by electrostatic force so that the ink droplet is ejected from the nozzle, the head drive and control device comprising:

a first part applying to said ink jet head a first driving signal for generating the electrostatic force for ejecting the ink droplet from the nozzle and a second driving signal for controlling deformation of the diaphragm, the second driving signal being applied after a predetermined period of time passes since application of the first driving signal, wherein in response to the first driving signal, the diaphragm is deformed toward the electrode and when the first driving signal is removed, the diaphragm deforms in a direction away from the electrode so that the ink droplet is ejected from the nozzle, the second driving signal being applied at a time when the diaphragm is moving in the direction away from the electrode, wherein the first and second driving signals are applied so as to eject a same ink droplet, and the second driving signal reduces a volume of ink to be ejected by the first driving signal, and the predetermined period of time between the first and second driving signals is included in a period between a timing a which the diaphragm passes an equilibrium position thereof in a direction away from the electrode and a timing at which the diaphragm reaches a position furthest from the electrode.

28. A method of driving and controlling an ink jet head including a nozzle for ejecting an ink droplet, an ink channel communicating with the nozzle, a diaphragm forming a part of wall faces of the ink channel, and an electrode opposing the diaphragm, the diaphragm being deformed by electrostatic force so that the ink droplet is ejected from the nozzle, the method comprises the step of:

(a) applying a second driving signal for controlling deformation of the diaphragm to the ink jet head after a predetermine period of time passes since application of a first driving signal for generating the electrostatic force for ejecting the ink droplet from the nozzle, wherein in response to the first driving signal, the diaphragm is deformed toward the electrode and when the first driving signal is removed, the diaphragm deforms in a direction away from the electrode so that the ink droplet is ejected from the nozzle, the second driving signal being applied at a time when the diaphragm is moving in the direction away from the electrode, wherein the first and second driving signals are applied so as to eject a same ink droplet, the second driving signal reduces a volume of ink to be ejected by the first driving signal, and the second driving signal is prevented from causing the diaphragm to come into contact with the electrode.

29. The method as claimed in claim 28, further comprising the step of:

(b) stopping application of the second driving signal before the diaphragm passes the equilibrium position in a direction toward the electrode.

30. The method as claimed in claim 28, wherein the first and second driving signals are rectangular pulse signals.

31. The method as claimed in claim 28, wherein the second driving signal has a peak value higher than that of the first driving signal.

32. The method as claimed in claim 28, wherein a peak value of the second driving signal varies in accordance with an image to be recorded.

33. The method as recited in claim 28, wherein the second driving signal is applied at a time when the diaphragm is moving in the direction away from the electrode so that the diaphragm does not reach its potentially furthest distance away from the electrode.

34. A method of driving and controlling an ink jet head including a nozzle for ejecting an ink droplet, an ink channel communicating with the nozzle, a diaphragm forming a part of wall faces of the ink channel, and an electrode opposing the diaphragm, the diaphragm being deformed by electrostatic force so that the ink droplet is ejected from the nozzle, the method comprises the step of:

(a) applying a second driving signal for controlling deformation of the diaphragm to the ink jet head after a predetermined period of time passes since application of a first driving signal for generating the electrostatic force for ejecting the ink droplet from the nozzle, wherein in response to the first driving signal, the diaphragm is deformed toward the electrode and when the first driving signal is removed, the diaphragm deforms in a direction away from the electrode so that the ink droplet is ejected from the nozzle, the second driving signal being applied at a time when the diaphragm is moving in the direction away from the electrode, wherein the first and second driving signals are applied so as to eject a same ink droplet, the second driving signal reduces a volume of ink to be ejected by the first driving signal, and said step (a) applies the second driving signal at a timing between a timing at which at the diaphragm passes an equilibrium position of the diaphragm in a direction away from the electrode and a timing at which the diaphragm reaches a position furthest from the electrode.

35. An ink jet recording apparatus comprising:

an ink jet head including a nozzle for ejecting an ink droplet, an ink channel communicating with the nozzle, a diaphragm forming a part of wall faces of the ink channel, and an electrode opposing the diaphragm, the diaphragm being deformed by electrostatic force so that the ink droplet is ejected from the nozzle; and a first part applying to said ink jet head a first driving signal for generating the electrostatic force so that the diaphragm is deformed to contact the electrode and a second driving signal having a peak value higher than that of the first driving signal, the second driving signal being applied before the diaphragm starting restoration by stopping application of the first driving signal reaches an equilibrium position of the diaphragm, wherein the first and second driving signals are applied so as to eject a same ink droplet, the second driving signal reduces a volume of ink to be ejected by the first driving signal, and the second driving signal is prevented from causing the diaphragm to come into contact with the electrode.

36. The ink jet recording apparatus as claimed in claim 35, further comprising a second part varying a timing at which application of the second driving signal is started.

37. A head drive and control device for driving and controlling an ink jet head including a nozzle for ejecting an ink droplet, an ink channel communicating with the nozzle, a diaphragm forming a part of wall faces of the ink channel, and an electrode opposing the diaphragm, the diaphragm being deformed by electrostatic force so that the ink droplet is rejected from the nozzle, the head drive and control device comprising:

a part applying to said ink jet head a first driving signal for generating the electrostatic force so that the diaphragm is deformed to contact the electrode and a second driving signal having a peak value higher than that of the first driving signal, the second driving signal being applied before the diaphragm starting restoration by stopping application of the first driving signal reaches an equilibrium position of the diaphragm, wherein the first and second driving signals are applied so as to eject a same ink droplet, the second driving signal reduces a volume of ink to be ejected by the first driving signal, and the second driving signal is prevented from causing the diaphragm to come into contact with the electrode.

38. An ink jet head comprising:

a nozzle for ejecting an ink droplet;

an ink channel communicating with said nozzle;

a diaphragm forming a part of wall faces of said ink channel;

a first electrode opposing said diaphragm to which first electrode a first driving signal for generating electrostatic force is applied, the electrostatic force deforming said diaphragm so that the ink droplet is ejected from said nozzle; and a second electrode to which a second driving signal for controlling deformation of said diaphragm is applied after a predetermined period of time passes since application of the first driving signal, wherein the first and second driving signals are applied so as to eject the same ink droplet, the second driving signal reduces a volume of ink to be ejected by the first driving signal, and the second driving signal is prevented from causing the diaphragm to come into contact with the electrode.

39. The ink jet head as claimed in claim 38, wherein said second electrode is an electrode substrate on which said first electrode is formed.

40. The ink jet head as claimed in claim 38, wherein said second electrode opposes the diaphragm only in a part of a surface of the electrode substrate on which said first and second electrodes are formed, the part corresponding to a neighboring area of said nozzle.

41. An ink jet head comprising:

a nozzle for ejecting an ink droplet;

an ink channel communicating with said nozzle;

a diaphragm forming a part of wall faces of said ink channel;

a first electrode opposing said diaphragm to which first electrode a first driving signal for generating electrostatic force is applied, the electrostatic force deforming said diaphragm a that the ink droplet is ejected from said nozzle; and a second electrode to which a second driving signal for controlling deformation of said diaphragm is applied after a predetermined period of time passes since application of the first driving signal, wherein in response to the first driving signal, the diaphragm is deformed toward the first electrode and when the first driving signal is removed, the diaphragm deforms in a direction away from the first electrode so that the ink droplet is ejected from the nozzle, the second driving signal being applied to the second electrode at a time when the diaphragm is moving in the direction away from the first electrode, and the first and second driving signals are applied so as to eject the same ink droplet, and the second driving signal reduces a volume of ink to be ejected by the first driving signal, and wherein the second driving signal is prevented from causing the diaphragm to come into contact with the electrode.

42. The ink jet head as recited in claim 41, wherein the second driving signal is applied at a time when the diaphragm is moving in the direction away from the first electrode so that the diaphragm does not reach its potentially furthest distance away from the first electrode.

43. An ink jet recording apparatus comprising:

an ink jet head including a nozzle for ejecting an ink droplet, an ink channel communicating with the nozzle, a diaphragm forming a part of wall faces of the ink channel, and an electrode opposing the diaphragm, the diaphragm being deformed by electrostatic force so that the ink droplet is ejected from the nozzle; and a part applying to said ink jet head a first driving signal for generating the electrostatic force for ejecting the ink droplet from the nozzle and a second driving signal for controlling deformation of the diaphragm, the second driving signal being applied after a predetermined period of time passes since application of the first driving signal, wherein in response to the first driving signal, the diaphragm is deformed toward the electrode and when the first driving signal is removed, the diaphragm deforms ma direction away from the electrode so that the ink droplet is ejected from the nozzle, the second driving signal being applied at a time when the diaphragm is moving in the direction away from the electrode, wherein the first and second driving signals are applied so as to eject a same ink droplet, the second driving signal reduces a volume of ink to be ejected by the first driving signal, and the second driving signal is applied at substantially half of a vibration cycle of the diaphragm after the diaphragm is released from the electrode by the removal of the first driving signal.

44. A head drive and control device for driving and controlling an ink jet head including a nozzle for ejecting an ink droplet, an ink channel communicating with the nozzle, diaphragm forming a part of wall faces of the ink channel, and a electrode opposing the diaphragm, the diaphragm being deformed by electrostatic force so that the ink droplet is ejected from the nozzle, the head drive and control device comprising:

a first part applying to said ink jet head a first driving signal for generating the electrostatic force for ejecting the ink droplet from the nozzle and a second driving signal for controlling deformation of the diaphragm, the second driving signal being applied after a predetermined period of time passes since application of the first driving signal, wherein in response to the first driving signal, the diaphragm is deformed toward the electrode and when the first driving signal is removed, the diaphragm deforms in a direction away from the electrode so that the ink droplet is ejected from the nozzle, the second driving signal being applied at a time when the diaphragm is moving in the direction away from the electrode, wherein the first and second driving signals are applied so as to eject a same ink droplet, and the second driving signal reduces a volume of ink to be ejected by the first driving signal, and wherein the second driving signal is applied at substantially a half of a vibration cycle of the diaphragm after the diaphragm is released from the electrode by the removal of the first driving signal.

45. A method of driving and controlling an ink jet head including a nozzle for ejecting an ink droplet, an ink channel communicating with the nozzle, a diaphragm forming a part of wall faces of the ink channel, and an electrode opposing the diaphragm, the diaphragm being deformed by electrostatic force so that the ink droplet is ejected from the nozzle, the method comprises the step of:

(a) applying a second driving signal for controlling deformation of the diaphragm to the ink jet head after a predetermined period of time passes since application of a first driving signal for generating the electrostatic force for ejecting the ink droplet from the nozzle, wherein in response to the first driving signal, the diaphragm is deformed toward the electrode and when the first driving signal is removed, the diaphragm deforms in a direction away from the electrode so that the ink droplet is ejected from the nozzle, the second driving signal being applied at a time when the diaphragm is moving in the direction away from the electrode, wherein the first and second driving signals are applied so as to eject a same ink droplet, the second driving signal reduces a volume of ink to be ejected by the first driving signal, and the second driving signal is applied at substantially half of a vibration cycle of the diaphragm after the diaphragm is released from the electrode by the removal of the first driving signal.

46. An ink jet recording apparatus comprising:

an ink jet head including a nozzle for ejecting an ink droplet, an ink channel communicating with the nozzle, a diaphragm forming a part of wall faces of the ink channel, and an electrode opposing the diaphragm, the diaphragm being deformed by electrostatic force so that the ink droplet is ejected from the nozzle; and a first part applying to said ink jet head a first driving signal for generating the electrostatic force so that the diaphragm is deformed to contact the electrode and a second driving signal having a peak value higher than that of the first driving signal, the second driving signal being applied before the diaphragm starting restoration by stopping application of the first driving signal reaches an equilibrium position of the diaphragm, wherein the first and second driving signals are applied so as to eject a same ink droplet, the second driving signal reduces a volume of ink to be ejected by the first driving signal, and the second driving signal is applied at substantially half of a vibration cycle of the diaphragm after the diaphragm is released from the electrode by the removal of the first driving signal.

47. A head drive and control device for driving and controlling an ink jet head including a nozzle for ejecting an ink droplet, an ink channel communicating with the nozzle, diaphragm forming a part of wall faces of the ink channel, and a electrode opposing the diaphragm, the diaphragm being deformed by electrostatic force so that the ink droplet is rejected from the nozzle, the head drive and control device comprising:

a part applying to said ink jet head a first driving signal for generating the electrostatic force so that the diaphragm is reformed to contact the electrode and a second driving signal having a peak value higher than that of the first driving signal, the second driving signal being applied before the diaphragm starting restoration by stopping application of the first driving signal reaches an equilibrium position of the diaphragm, wherein the first and second driving signals are applied so as to eject a same ink droplet, the second driving signal reduces a volume of ink to be ejected by the first driving signal, and the second driving signal is applied at substantially half of a vibration cycle of the diaphragm after the diaphragm is released from the electrode by the removal of the first driving signal.

48. An ink jet head comprising:

a nozzle for ejecting an ink droplet;

an ink channel communicating with said nozzle;

a diaphragm forming a part of wall faces of said ink channel;

a first electrode opposing said diaphragm to which first electrode a first driving signal for generating electrostatic force is applied, the electrostatic force deforming said diaphragm so that the ink droplet is ejected from said nozzle; and a second electrode to which a second driving signal for controlling deformation of said diaphragm is applied after a predetermined period of time passes since application of the first driving signal, wherein the first and second driving signals are applied so as to eject the same ink droplet, the second driving signal reduces a volume of ink to be ejected by the first driving signal, and the second driving signal is applied at substantially half of a vibration cycle of the diaphragm after the diaphragm is released from the electrode by the removal of the first driving signal.

49. An ink jet head comprising:

a nozzle for ejecting an ink droplet;

an ink channel communicating with said nozzle;

a diaphragm forming a part of wall faces of said ink channel;

a first electrode opposing said diaphragm to which first electrode a first driving signal for generating electrostatic force is applied, the electrostatic force deforming said diaphragm so that the ink droplet is ejected from said nozzle; and a second electrode to which a second driving signal for controlling deformation of said diaphragm is applied after a predetermined period of time passes since application of the first driving signal, wherein in response to the first driving signal, the diaphragm is deformed toward the first electrode and when the first driving signal is removed, the diaphragm deforms in a direction away from the first electrode so that the ink droplet is ejected from the nozzle, the second driving signal being applied to the second electrode at a time when the diaphragm is moving in the direction away from the first electrode, and the first and second driving signals are applied so as to eject the same ink droplet, and the second driving signal reduces a volume of ink to be ejected by the first driving signal, and wherein the second driving signal is applied at substantially a half of a vibration cycle of the diaphragm after the diaphragm is released from the electrode by the removal of the first driving signal.

* * * * *